US008172670B2

(12) United States Patent
Frick

(10) Patent No.: US 8,172,670 B2
(45) Date of Patent: May 8, 2012

(54) CONFIGURATION FOR A SUPPLEMENTAL GAME

(75) Inventor: Michael D. Frick, Crawfordville, FL (US)

(73) Assignee: Integrated Group Assets Inc., Crawfordville, FL (US)

( * ) Notice: Subject to any disclaimer, the term of this patent is extended or adjusted under 35 U.S.C. 154(b) by 567 days.

(21) Appl. No.: 12/396,604

(22) Filed: Mar. 3, 2009

(65) Prior Publication Data

US 2010/0203951 A1 Aug. 12, 2010

Related U.S. Application Data

(63) Continuation-in-part of application No. 12/367,517, filed on Feb. 7, 2009.

(51) Int. Cl.
*A63F 9/24* (2006.01)

(52) U.S. Cl. ..... 463/22

(58) Field of Classification Search ..... 463/15–26
See application file for complete search history.

(56) References Cited

U.S. PATENT DOCUMENTS

| | | | | |
|---|---|---|---|---|
| 6,800,026 | B2 * | 10/2004 | Cannon | 463/16 |
| 2001/0008842 | A1 * | 7/2001 | Walker et al. | 463/16 |
| 2002/0010022 | A1 * | 1/2002 | Vincent | 463/42 |
| 2003/0114210 | A1 * | 6/2003 | Meyer et al. | 463/17 |
| 2006/0100008 | A1 * | 5/2006 | Wright et al. | 463/17 |
| 2007/0026927 | A1 * | 2/2007 | Yaldoo et al. | 463/17 |
| 2007/0060244 | A1 * | 3/2007 | Yaldoo et al. | 463/16 |
| 2008/0254853 | A1 * | 10/2008 | Wright et al. | 463/17 |

* cited by examiner

*Primary Examiner* — Ha Tran T Nguyen
*Assistant Examiner* — Vongsavanh Sengdara
(74) *Attorney, Agent, or Firm* — Samuel K. Simpson; Patent Ingenuity, P.C.

(57) ABSTRACT

A process generates, with a prize category display module, a display that indicates (i) a first prize and a second prize for a primary game and (ii) a supplemental game prize, the first prize being won by a player that provides a first wager and has a match between a set of primary game player numbers and a set of primary game winning numbers. The second prize is won by a player that provides a second wager and has a match between the set of primary game player numbers and the set of primary game winning numbers. The second wager is greater than the first wager. The second prize is greater than the first prize, each of the first wager and the second wager additionally providing entry into a supplemental game.

102 Claims, 20 Drawing Sheets

100

| 102 | 104 | 106 | 108 | 110 | 112 | 114 |
|---|---|---|---|---|---|---|
| A | n | y | W | o | r | d |
| 1 | 1 | 1 | 1 | 1 | 1 | 1 |
| 2 | 2 | 2 | 2 | 2 | 2 | 2 |
| 3 | 3 | 3 | 3 | 3 | 3 | 3 |
| 4 | 4 | 4 | 4 | 4 | 4 | 4 |
| 5 | 5 | 5 | 5 | 5 | 5 | 5 |
| 6 | 6 | 6 | 6 | 6 | 6 | 6 |
| 7 | 7 | 7 | 7 | 7 | 7 | 7 |
| 8 | 8 | 8 | 8 | 8 | 8 | 8 |
| 9 | 9 | 9 | 9 | 9 | 9 | 9 |
| 10 | 10 | 10 | 10 | 10 | 10 | 10 |
| 11 | 11 | 11 | 11 | 11 | 11 | 11 |

*Figure 1*

200

Hybrid Game Prize Structure

1 Spot 202

| Wager (204) | 6 columns (206) | 7 columns (208) |
|---|---|---|
| $10 (210) | $700,000 (214) | $7,000,000 (216) |
| $2 (212) | $100,000 (218) | $1,000,000 (220) |

2 Spot 220

| Wager (222) | 6 columns (224) | 7 columns (226) |
|---|---|---|
| $10 (228) | $5,000 (232) | $50,000 (234) |
| $2 (230) | $1,000 (236) | $10,000 (238) |

*Figure 2*

500

| 102 | 104 | 106 | 108 | 110 | 112 | 114 |
|---|---|---|---|---|---|---|
| A | n | y | W | o | r | d |
| 1 | 1 | 1 | 1 | 1 | 1 | 1 |
| 2 | 2 | 2 | 2 | 2 | 2 | 2 |
| 3 | 3 | 3 | 3 | 3 | 3 | 3 |
| 4 | 4 | 4 | 4 | 4 | 4 | 4 |
| 5 | 5 | 5 | 5 | 5 | 5 | 5 |
| 6 | 6 | 6 | 6 | 6 | 6 | 6 |
| 7 | 7 | 7 | 7 | 7 | 7 | 7 |
| 8 | 8 | 8 | 8 | 8 | 8 | 8 |
| 9 | 9 | 9 | 9 | 9 | 9 | 9 |
| 10 | 10 | 10 | 10 | 10 | 10 | 10 |
| 11 | 11 | 11 | 11 | 11 | 11 | 11 |

*Figure 5*

Expected Payout Table

1300

| Spot (1302) | $1 (1304) | $2 (1306) | Average Expected Payout (1308) |
|---|---|---|---|
| 1 Spot (1310) | 52% (1318) | 56% (1326) | 54% (1334) |
| 2 Spot (1312) | 48% (1320) | 52% (1328) | 50% (1336) |
| 3 Spot (1314) | 47% (1322) | 49% (1330) | 48% (1338) |
| 4 Spot (1316) | 47% (1324) | 49% (1332) | 48% (1340) |
| **Aggregate** | **48.50%** | **51.50%** | **50.00%** |

*Figure 13*

1500

Hybrid Game and Supplemental Game Prize Structure

1 Spot Hybrid Game Prize Configuration 1502

| Wager (204) | 6 columns (206) | 7 columns (208) |
|---|---|---|
| $11 (210) | $700,000 (214) | $7,000,000 (216) |
| $3 (212) | $100,000 (218) | $1,000,000 (220) |

2 Spot Hybrid Game Prize Configuration 1504

| Wager (222) | 6 columns (224) | 7 columns (226) |
|---|---|---|
| $11 (228) | $5,000 (232) | $50,000 (234) |
| $3 (230) | $1,000 (236) | $10,000 (238) |

Supplemental Game Prize Configuration 1506

| Wager (222) | Partial Match (1508) | Full Match (1510) |
|---|---|---|
| $11 (1512) | $10,000 (1516) | $1,000,000 (1518) |
| $3 (1514) | $100 (1520) | $100,000 (1522) |

*Figure 15*

Combined Base Game and Add-on Game with Supplemental Game Prize Structure

1800

| Match (1802) | $1 (1804) | $2 (1806) | $3 (1808) |
|---|---|---|---|
| 6 of 6 (1810) | Jackpot (1818) | Jackpot (1818) & Supp. (1820) | Jackpot (1818) & Supp. (1820) |
| 5 of 6 (1812) | $1,000 (1822) | $2,000 (1824) + Supp. (1820) | $5,000 (1826) & Supp. (1820) |
| 4 of 6 (1814) | $100 (1828) | $200 (1830) + Supp. (1820) | $500 (1832) & Supp. (1820) |
| 3 of 6 (1816) | $10 (1834) | $20 (1836) + Supp. (1820) | $50 (1838) & Supp. (1820) |

*Figure 18*

CONFIGURATION FOR A SUPPLEMENTAL GAME

RELATED APPLICATIONS

This application is a Continuation-In-Part application of U.S. patent application Ser. No. 12/367,517, filed on Feb. 7, 2009 and entitled CONFIGURATION FOR A HYBRID GAME, which is hereby incorporated by reference in its entirety.

BACKGROUND

1. Field

This disclosure generally relates to the field of gaming. More particularly, the disclosure relates to a hybrid game.

2. General Background

Over the past 15 years, many lotteries have experienced an erosion of net profit margins primarily as the result of sales shifts from higher margin product segments like numbers and lotto games to lower margin product segments like instant games. In 1992, for example, higher margin games made up approximately two thirds of total U.S. lottery sales and instant games represented less than a third of total U.S. lottery sales. By 2007, traditional higher margin games represented slightly more than one third of total U.S. lottery sales while instant sales had grown to over one half of total U.S. lottery sales. Typical instant games currently carry prize costs that are approximately thirty percent greater than corresponding traditional numbers, lotto and raffle games.

The result of this shift in sales to lower margin products has allowed sales to grow, but at the expense of net profit margins. Since 2005, several lotteries have suffered year-over-year declines in net profits despite having achieved record or near-record annual sales levels.

SUMMARY

In one aspect of the disclosure, a process is provided. The process generates, with a wager slip generation apparatus, a plurality of wager slips corresponding to a hybrid game such that each wager slip indicates a plurality of parallel matrices that each has a set of corresponding parallel matrix specific numbers. Further, the process generates, with a prize category display module, a display that indicates a first spot low prize and a first spot high prize. The first spot low prize is won by a player providing a first wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. The first spot high prize is won by a player providing a second wager and having the predetermined number of first spot matched parallel matrices, the second wager being greater than the first wager. The first wager and the second wager each additionally provide entry for the player in a supplemental game. Further, the process generates, with the prize category display module, a display that indicates a second spot low prize and a second spot high prize. The second spot low prize is won by a player providing the first wager and having a predetermined number of second spot matched parallel matrices. Each second spot matched parallel matrix has a match between a second spot quantity of numbers selected by the player from the set of corresponding parallel matrix specific numbers and a quantity of randomly drawn numbers from the set of corresponding parallel matrix specific numbers. The second spot high prize is won by a player providing a second wager and having the predetermined number of second spot matched parallel matrices. The second wager is greater than the first wager. The second spot high prize is less than the first spot high prize. In addition, the process receives, from each player, a selection of the spot quantity of numbers corresponding to each parallel matrix generated on one of the plurality of wager slips. The process also receives, from each player, one of the first wager or the second wager. Further, the process prints, with a ticket generation apparatus, a plurality of hybrid game tickets that are each based on player selections of numbers indicated on the plurality of wager slips and a set of player numbers for the supplemental game. In addition, the process performs, with a hybrid game random selection apparatus, a random selection in each of the parallel matrices of at least one winning number from the set of corresponding parallel matrix specific numbers. The process also performs, with a supplemental game random selection apparatus, a random selection for a set of winning numbers for the supplemental game. The supplemental game random selection apparatus is distinct from the hybrid game random selection apparatus. The process also performs, with the random selection apparatus, a random selection for a set of winning numbers for the supplemental game. Further, the process provides a hybrid game prize to a player in the hybrid game having a winning hybrid game ticket based on (i) spot quantity selected by the player, (ii) wager provided by the player, and (iii) the predetermined number of matched parallel matrices. In addition, the process provides a supplemental game prize to a player in the supplemental game having a match between the set of player numbers for the supplemental game and the set of winning numbers for the supplemental game.

In another aspect of the disclosure, a computer program product is provided. The computer program product includes a computer useable medium having a computer readable program. The computer readable program when executed on a computer causes the computer to generate, with a wager slip generation apparatus, a plurality of wager slips corresponding to a hybrid game such that each wager slip indicates a plurality of parallel matrices that each has a set of corresponding parallel matrix specific numbers. Further, the computer readable program when executed on the computer causes the computer to generate, with a prize category display module, a display that indicates a first spot low prize and a first spot high prize. The first spot low prize is won by a player providing a first wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. The first spot high prize is won by a player providing a second wager and having the predetermined number of first spot matched parallel matrices, the second wager being greater than the first wager. The first wager and the second wager each additionally provide entry for the player in a supplemental game. Further, the computer readable program when executed on the computer causes the computer to generate, with the prize category display module, a display that indicates a second spot low prize and a second spot high prize. The second spot low prize is won by a player providing the first wager and having a predetermined number of second spot matched parallel matrices. Each second spot matched parallel matrix has a match between a second spot quantity of numbers selected by the player from the set of corresponding parallel matrix specific numbers and a quantity of randomly drawn numbers from the set of corresponding parallel matrix specific numbers. The second spot high prize is won by a player providing a second wager and having the predetermined number of second spot matched parallel matrices. The second wager is greater than the first wager. The second spot high prize is less than the first spot high prize. In addition, the computer readable program when executed on the computer causes the computer to receive, from each player, a selection of the spot quantity of numbers corresponding to each parallel matrix generated on one of the plurality of wager slips. The computer readable program when executed on the computer also causes the computer to receive, from each player, one of the first wager or the second wager. Further, the computer readable program when executed on the computer causes the computer to print, with a ticket generation apparatus, a plurality of hybrid game tickets that are each based on player selections of numbers indicated on the plurality of wager slips and a set of player numbers for the supplemental game. In addition, the computer readable program when executed on the computer causes the computer to perform, with a hybrid game random selection apparatus, a random selection in each of the parallel matrices of at least one winning number from the set of corresponding parallel matrix specific numbers. The computer readable program when executed on the computer also causes the computer to perform, with a supplemental game random selection apparatus, a random selection for a set of winning numbers for the supplemental game. The supplemental game random selection apparatus is distinct from the hybrid game random selection apparatus. Further, the computer readable program when executed on the computer causes the computer to provide a hybrid game prize to a player in the hybrid game having a winning hybrid game ticket based on (i) spot quantity selected by the player, (ii) wager provided by the player, and (iii) the predetermined number of matched parallel matrices. In addition, the computer readable program when executed on the computer causes the computer to provide a supplemental game prize to a player in the supplemental game having a match between the set of player numbers for the supplemental game and the set of winning numbers for the supplemental game.

In yet another aspect of the disclosure, a system is provided. The system includes a wager slip generation apparatus that generates a plurality of wager slips corresponding to a hybrid game such that each wager slip indicates a plurality of parallel matrices that each has a set of corresponding parallel matrix specific numbers. Further, the system includes a prize category display module that generates a display that indicates a first spot low prize, a first spot high prize, a second spot low prize, and a second spot high prize. The first spot low prize is won by a player providing a first wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. The first spot high prize is won by a player providing a second wager and having the predetermined number of first spot matched parallel matrices. The second wager is greater than the first wager. The second spot low prize is won by a player providing the first wager and having a predetermined number of second spot matched parallel matrices. Each second spot matched column has a match between a second spot quantity of numbers selected by the player from the set of corresponding parallel matrix specific numbers and a quantity of randomly drawn numbers from the set of corresponding parallel matrix specific numbers. The second spot high prize is won by a player providing a second wager and having the predetermined number of second spot matched parallel matrices. The second wager is greater than the first wager. The second spot high prize is less than the first spot high prize. The first wager and the second wager each additionally provide entry for the player in a supplemental game. In addition, the system includes a spot quantity reception module that receives, from a player, a selection of the spot quantity of numbers corresponding to each parallel matrix generated on one of the plurality of wager slips. The system also includes a payment reception module that receives, from each player, one of the first wager or the second wager. Further, the system includes a hybrid game ticket printer that prints a plurality of hybrid game tickets that are each based on player selections of numbers indicated on the plurality of wager slips and a set of player numbers for the supplemental game on each of the plurality of hybrid game tickets. The system also includes a hybrid game random selection apparatus that performs a random selection in each of the parallel matrices of at least one winning number from the set of corresponding parallel matrix specific numbers. The system also includes a supplemental game random selection apparatus that performs a random selection for a set of winning numbers for the supplemental game. Further, the system includes a hybrid game prize distribution module that provides a hybrid game prize to a player having a winning hybrid game ticket based on (i) spot quantity selected by the player, (ii) wager provided by the player, and (iii) the predetermined number of matched parallel matrices. In addition, the system includes a supplemental game prize distribution module that provides a supplemental game prize to a player in the supplemental game having a match between the set of player numbers for the supplemental game and the set of winning numbers for the supplemental game.

In another aspect of the disclosure, a process is provided. The process generates, with a prize category display module, a display that indicates (i) a first prize and a second prize for a primary game and (ii) a supplemental game prize, the first prize being won by a player that provides a first wager and has a match between a set of primary game player numbers and a set of primary game winning numbers. The second prize is won by a player that provides a second wager and has a match between the set of primary game player numbers and the set of primary game winning numbers. The second wager is greater than the first wager. The second prize is greater than the first prize. Each of the first wager and the second wager additionally provide entry into a supplemental game. Further, the process receives, from each player, one of the first wager or the second wager. In addition, the process prints, with a ticket generation apparatus, a plurality of game tickets that are each based on the set of primary game player numbers and a set of supplemental game player numbers. The process also performs, with a primary game random selection apparatus, a random selection of the set of primary game winning numbers. The process also performs, with a supplemental game random selection apparatus, a random selection of a set of supplemental game winning numbers. The supplemental game random selection apparatus is distinct from the primary game random selection apparatus. Further, the process provides a primary game prize to a player in the primary game having a winning primary game ticket based on the match between the set of primary game player numbers and the set of primary game winning numbers. In addition, the process provides the supplemental game prize to a player in the supplemental game having a winning supplemental game ticket based on the match between the set of supplemental game player numbers and the set of supplemental game winning numbers.

In yet another aspect of the disclosure, a computer program product is provided. The computer program product includes a computer useable medium having a computer readable program. The computer readable program when executed on a computer causes the computer to generate, with a prize category display module, a display that indicates (i) a first prize and a second prize for a primary game and (ii) a supplemental game prize, the first prize being won by a player that provides a first wager and has a match between a set of primary game player numbers and a set of primary game winning numbers. The second prize is won by a player that provides a second wager and has a match between the set of primary game player numbers and the set of primary game winning numbers, the second wager being greater than the first wager. The second prize is greater than the first prize. Each of the first wager and the second wager additionally provide entry into a supplemental game. Further, the computer readable program when executed on a computer causes the computer to receive, from each player, one of the first wager or the second wager. In addition, the computer readable program when executed on a computer causes the computer to print, with a ticket generation apparatus, a plurality of game tickets that are each based on the set of primary game player numbers and a set of supplemental game player numbers. The computer readable program when executed on a computer also causes the computer to perform, with a primary game random selection apparatus, a random selection of the set of primary game winning numbers. The computer readable program when executed on a computer also causes the computer to perform, with a supplemental game random selection apparatus, a random selection of a set of supplemental game winning numbers, the supplemental game random selection apparatus being distinct from the primary game random selection apparatus. Further, the computer readable program when executed on a computer causes the computer to provide a primary game prize to a player in the primary game having a winning primary game ticket based on the match between the set of primary game player numbers and the set of primary game winning numbers. In addition, the computer readable program when executed on a computer causes the computer to provide the supplemental game prize to a player in the supplemental game having a winning supplemental game ticket based on the match between the set of supplemental game player numbers and the set of supplemental game winning numbers.

In another aspect of the disclosure, a system is provided. The system includes a prize category display module that generates a display that indicates (i) a first prize and a second prize for a primary game and (ii) a supplemental game prize, the first prize being won by a player that provides a first wager and has a match between a set of primary game player numbers and a set of primary game winning numbers. The second prize is won by a player that provides a second wager and has a match between the set of primary game player numbers and the set of primary game winning numbers, the second wager being greater than the first wager. The second prize is greater than the first prize, each of the first wager and the second wager additionally providing entry into a supplemental game. Further, the system includes a payment reception module that receives, from each player, one of the first wager or the second wager. In addition, the system includes a ticket printer that prints a plurality of game tickets that are each based on the set of primary game player numbers and a set of supplemental game player numbers. The system also includes a primary game random selection apparatus that performs a random selection of the set of primary game winning numbers. The system also includes a supplemental game random selection apparatus that performs a random selection of a set of supplemental game winning numbers. The supplemental game random selection apparatus is distinct from the primary game random selection apparatus. Further, the system includes a primary game prize distribution module that provides a primary game prize to a player in the primary game having a winning primary game ticket based on the match between the set of primary game player numbers and the set of primary game winning numbers. In addition, the system includes the supplemental game prize distribution module that provides a supplemental game prize to a player in the supplemental game having a winning supplemental game ticket based on the match between the set of supplemental game player numbers and the set of supplemental game winning numbers.

BRIEF DESCRIPTION OF THE DRAWINGS

The above-mentioned features of the present disclosure will become more apparent with reference to the following description taken in conjunction with the accompanying drawings wherein like reference numerals denote like elements and in which:

FIG. 1 illustrates an example of a number selection portion of a wager slip for a hybrid game ticket.

FIG. 2 illustrates a hybrid game prize structure.

FIG. 5 illustrates an example of a number selection portion of a wager slip for a hybrid game ticket that provides visual indicia to distinguish between parallel matrices.

FIG. 13 illustrates an expected payout table.

FIG. 15 illustrates a hybrid game and supplemental game prize structure.

FIG. 18 illustrates a combined base game and add-on game with a supplemental game prize structure.

DETAILED DESCRIPTION

Figure 3A:
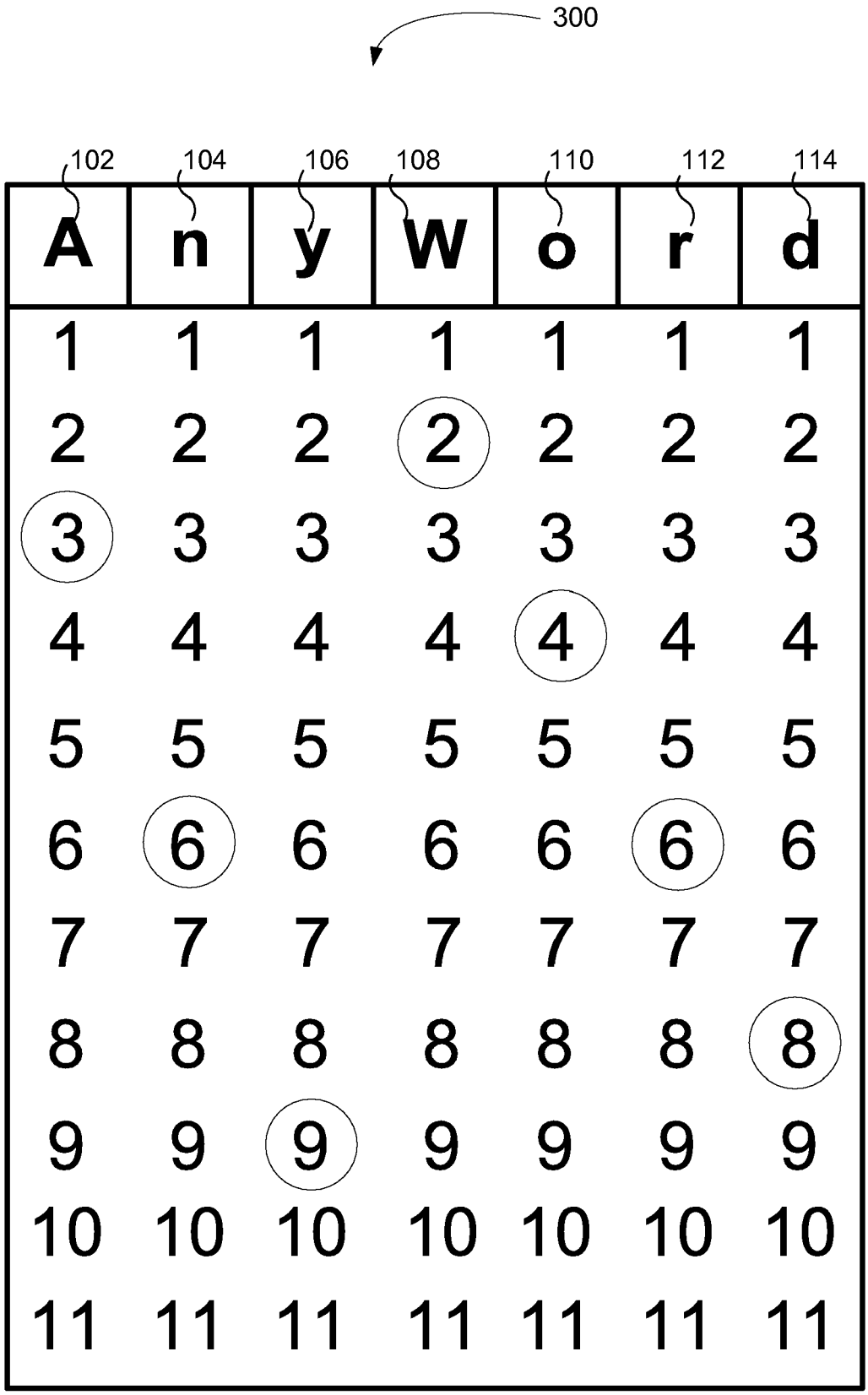
FIG. 3A provides an example of a number selection portion of a wager slip for a hybrid game ticket for which a player has selected a one spot.

A configuration that provides a hybrid game is disclosed. The hybrid game may be a unique combination of elements from a variety of games of chance. The configuration may be implemented to provide for a paper ticket, an electronic ticket, a virtual ticket, a game played on the Internet or any other wireless medium, a slot machine game, an online instant game, a scratch-off instant game, a peel-off instant game, an online drawing game, etc.

FIG. 1 illustrates an example of a number selection portion 100 of a wager slip for a hybrid game ticket. The number selection portion 100 of the wager slip for the hybrid game ticket has a plurality of parallel matrices. In one embodiment, the parallel matrices are columns. In another embodiment, the parallel matrices are rows. In yet another embodiment, the parallel matrices are diagonals. In yet another embodiment, a combination of columns, rows, and/or diagonals may be utilized. For illustrative purposes, the example of the number selection portion 100 of the wager slip for a hybrid game ticket in FIG. 1 has a plurality of seven columns. However, a different number of columns or any other parallel matrices may be utilized. In other words, any configuration of arrangement of parallel matrices may be utilized. If the matrices are columns, rows, or diagonals, the term vectors may be utilized to refer to such matrices.

In one embodiment, each of the columns has an identical set of sequential numbers. For example, each column in FIG. 1 is illustrated as having the numbers one through eleven. In another embodiment, the columns may have an identical set of non-sequential numbers. For example, each column in FIG. 1 may have the numbers one through ten and twelve. In yet another embodiment, the columns may have a distinct set of sequential numbers. For example, the first column may have the numbers one through eleven, the second column may have the numbers twelve through twenty two, etc. In another embodiment, the columns may have a distinct set of non-sequential numbers. For example, the first column may have the numbers one through ten and twelve, the second column may have the numbers thirteen through twenty two and twenty four, etc.

Further, the hybrid game ticket indicates a plurality of parallel matrix indicia that indicate a specific parallel matrix. For example, a first column indicia 102 indicates the letter "A," a second column indicia 104 indicates the letter "n," a third column indicia 106 indicates the letter "y," a fourth column indicia 108 indicates the letter "W," a fifth column indicia 110 indicates the letter "o," a sixth column indicia 112 indicates the letter "r," and a seventh column indicia 114 indicates the letter "d." The parallel matrix indicia provide an indication of the particular parallel matrix for which a player has selected a quantity of one or more player numbers. The player has to match a number to a specific parallel matrix for a winning number that is randomly selected, e.g., drawn, for that particular parallel matrix. For example, a player selecting player numbers for the first column that are drawn for the second column does not result in a winning hybrid game ticket.

In one embodiment, a match in a particular parallel matrix may increase the prize amount. For example, the fourth column having the fourth column indicia 108 of the letter "W" may have a doubler feature that doubles the prize amount won by a player. In one embodiment, the doubler is only applicable to prizes other than a jackpot or top prize.

In one embodiment, the player selects a spot quantity for the player numbers that are selected for each parallel matrix. The spot quantity is less than the total number of numbers in the parallel matrix. For example, the player may select a one spot such that the player can select one number for each parallel matrix. A player only has one chance to match the number for that particular parallel matrix. As another example, a player may select a two spot such that the player can select two numbers for each parallel matrix. Accordingly, for each parallel matrix, the player has two chances to match the one number that is drawn for the particular parallel matrix. As a result, the player will be able to win a larger prize for a lesser spot. In other words, a player has only once chance to obtain a match for a particular parallel matrix with a selection of a one spot as opposed to two chances to obtain a match for a particular with a two spot. Therefore, a player wins a larger prize for a smaller spot, which provides a smaller chance of winning.

In one embodiment, the choice of spot quantities is consistent throughout all of the parallel matrices. For example, the player may have the ability to choose between a one spot and a two spot for each parallel matrix. In another embodiment, the choice of spot quantities may be different amongst the parallel matrices. For example, the player may be able to choose between the first spot quantity and the second spot quantity in the first column, but may have to select the first spot quantity for the remaining six columns.

In another embodiment, the parallel matrices may be reels on a slot machine. The arrangement of parallel matrices may be displayed in a grid on the slot machine. Further, an electronic version, e.g., an Internet game that is played through a computing device, may also display an electronic version or the like of reels.

FIG. 2 illustrates a hybrid game prize structure 200. The hybrid game prize structure 200 includes a one spot prize structure 202 and a two spot prize structure 220. These prize structures are provided as examples. Many other spot prize structures may be provided within a given game, e.g., a three spot prize structure, a four spot prize structure, and a five spot prize structure. The one spot prize structure 202 includes a wager field 204, a six columns field 206, and a seven columns field 208. If the player selects a one spot, i.e., only one number for each parallel matrix, and provides a first wager 210, e.g., ten dollars, the player may win a six column one spot prize 214, e.g., seven hundred thousand dollars. If the player selects a one spot and provides the first wager 210, the player may win a seven column one spot prize 214, e.g., seven million dollars. The player may alternatively provide a lower wager such as a second wager 212 to win a six column one spot prize 218, e.g., one hundred thousand dollars, or a seven column one spot prize 220, e.g., one million dollars.

The two spot prize structure 220 includes a wager field 222, a six columns field 224, and a seven columns field 226. If the player selects a two spot, i.e., two numbers for each parallel matrix in a matrix, and provides a first wager 228, e.g., ten dollars, the player may win a six column two spot prize 232, e.g., five thousand dollars. If the player selects a two spot and provides the first wager 228, the player may win a seven column two spot prize 214, e.g., fifty thousand dollars. The player may alternatively provide a lower wager such as a second wager 230 to win a six column two spot prize 236, e.g., one thousand dollars, or a seven columns two spot prize 238, e.g., ten thousand dollars.

For illustrative purposes, six column and seven column prizes are provided. However, any number of columns less than or equal to the total number of columns may have corresponding prizes. Further, the same occurs with any parallel matrix configuration utilized. In one embodiment, a combination of different types of parallel matrices, e.g., columns, rows, and/or diagonals may have corresponding prizes.

For illustrative purposes, two wagers are provided. However, more than two wagers may be utilized. The player receives a higher prize for providing a higher wager. Alternatively, any of the configurations provided herein may be utilized with a single price point.

FIG. 3A provides an example of a number selection portion 300 of a wager slip for a hybrid game ticket for which a player has selected a one spot. As illustrated, the player has selected the number three in the first column, the number six in the second column, the number nine in the third column, the number two in the fourth column, the number four in the fifth column, the number six in the sixth column, and the number eight in the seventh column. The selection of the numbers may be performed by shading, drawing a circle, drawing a box, or the like.

Figure 3B:
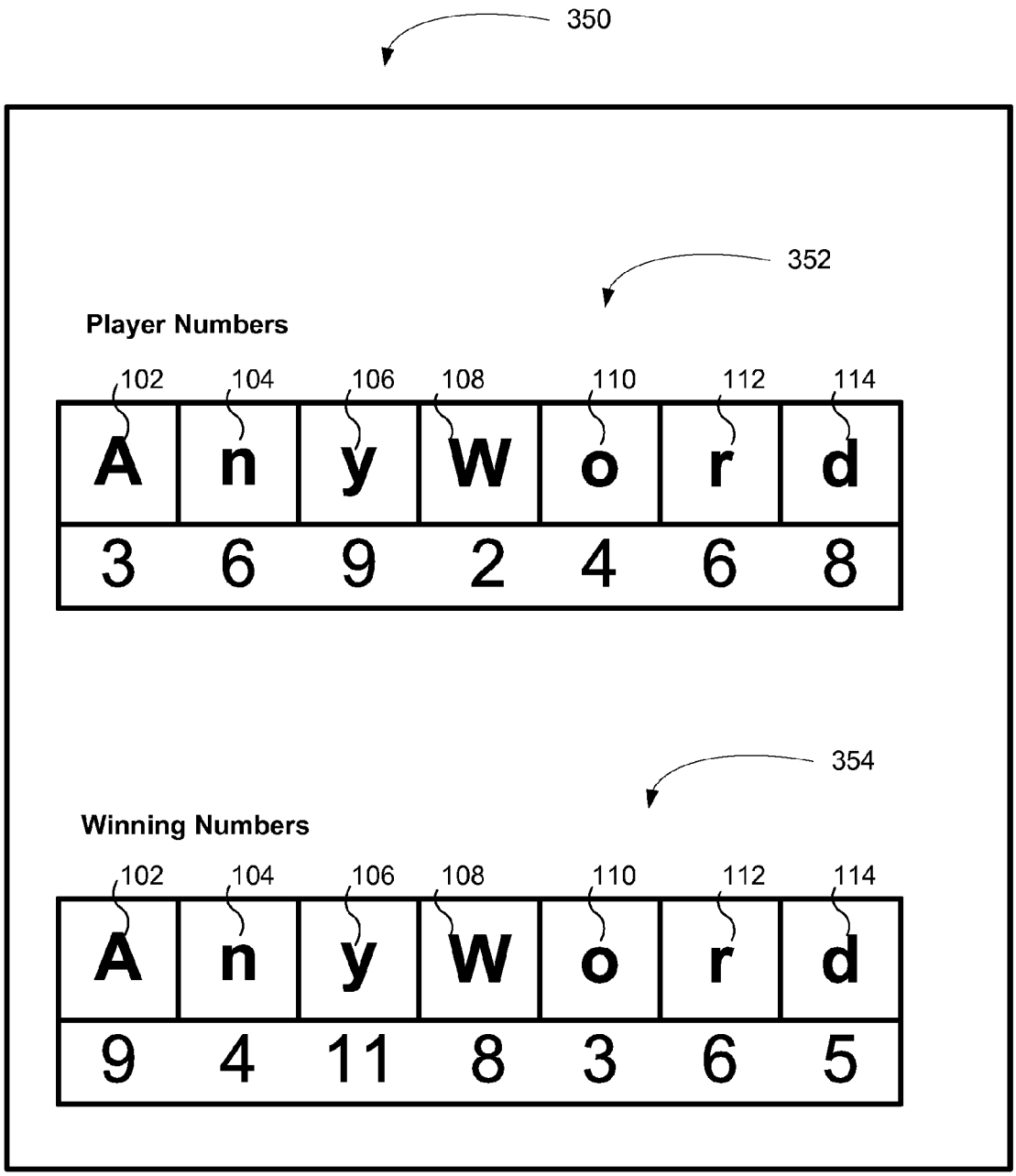
FIG. 3B illustrates an example of a "one spot" hybrid game ticket for an instant hybrid game.

FIG. 3B illustrates an example of a hybrid game ticket 350 for an instant hybrid game. The hybrid game ticket 350 includes a set of player numbers 352 and a set of winning numbers 354. Each of the winning numbers is randomly drawn for each column in the hybrid game for which the hybrid game ticket 350 was purchased. The set of player numbers 352 includes the numbers selected from the number selection portion 300 of the wager slip illustrated in FIG. 3A. As illustrated in FIG. 3B, the randomly drawn numbers are the number nine in the first column, the number four in the second column, the number eleven in the third column, the number eight in the fourth column, the number three in the fifth column, the number six in the sixth column, and the number five in the seventh column. Accordingly, the player has matched only one number, i.e., the number six in the sixth column. The instant version of the hybrid game is provided for illustrative purposes only. A draw-based version of the hybrid game may be utilized. In a draw-based version of the hybrid game, the randomly drawn numbers cannot be printed on the ticket because the randomly drawn numbers are not known until a drawing occurs after the ticket is printed. Accordingly, the player numbers without the randomly drawn numbers are printed on a draw-based version of the hybrid game.

Figure 4A:
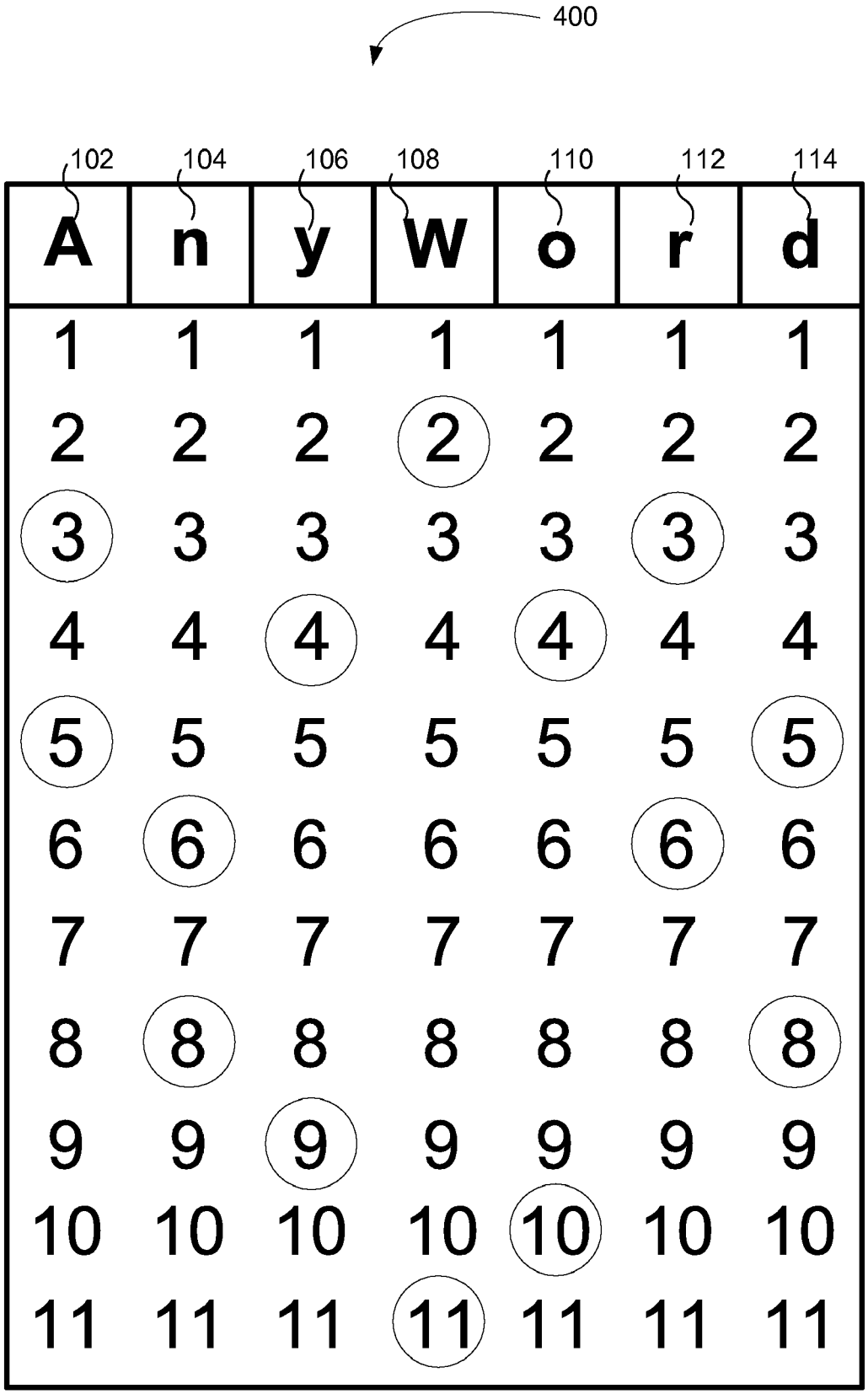
FIG. 4A provides an example an example of a number selection portion of a wager slip for a hybrid game ticket for which a player has selected a two spot.

FIG. 4A provides an example an example of a number selection portion 400 of a wager slip for a hybrid game ticket for which a player has selected a two spot. As illustrated, the player has selected the numbers three and five in the first column, the numbers six and eight in the second column, the numbers four and nine in the third column, the numbers two and eleven in the fourth column, the numbers four and ten in the fifth column, the numbers three and six in the sixth column, and the numbers five and eight in the seventh column. The set of winning numbers 354 illustrated in FIG. 3B is also applicable to the two spot. The player with the two simply has more chances to match each number drawn for a particular column, but wins a lesser prize for the same number of columns matched because of having greater chances of winning. The player with the hybrid game ticket 400 matches two columns because the number drawn for the sixth column, e.g., six, is included within the two numbers selected by the player for the sixth column, e.g., three and six, and the number drawn for the seventh column, e.g., five, is included within the two numbers selected by the player for the seventh column, e.g., five and eight.

Figure 4B:
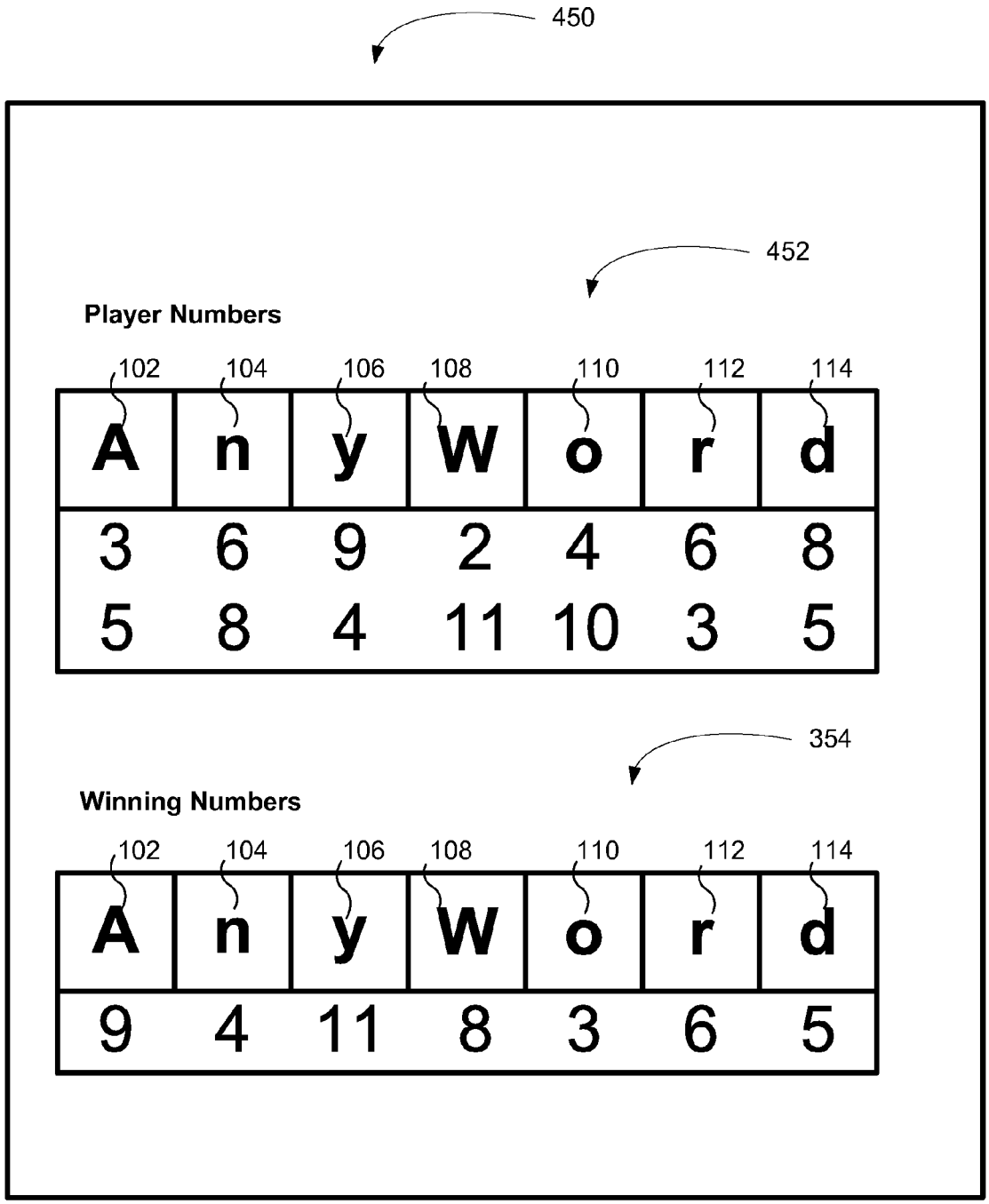
FIG. 4B illustrates an example of a "two spot" hybrid game ticket for an instant hybrid game.

FIG. 4B illustrates an example of a hybrid game ticket 450 for an instant hybrid game. The hybrid game ticket 450 includes a set of player numbers 452 and the set of winning numbers 354. The set of winning numbers 354 is the same set of winning numbers illustrated in FIG. 3B as the set of winning numbers is applicable to both the one spot tickets and the two spot tickets. The set of player numbers 452 includes the numbers selected from the number selection portion 400 of the wager slip illustrated in FIG. 4A. As illustrated in FIG. 4B, the randomly drawn numbers are the number nine in the first column, the number four in the second column, the number eleven in the third column, the number eight in the fourth column, the number three in the fifth column, the number six in the sixth column, and the number five in the seventh column. Accordingly, the player has matched only one number, i.e., the number six in the sixth column. The instant version of the hybrid game is provided for illustrative purposes only. A draw-based version of the hybrid game may be utilized.

In one embodiment, the number of parallel matrices matched is a factor for determining the amount of the prize. For instance, a predetermined number of parallel matrices may have to be matched to win a type of prize. As an example, six of seven columns may have to be matched to win a top prize whereas five of seven columns being matched, four of seven columns being matched, or three of seven columns being matched may provide a variety of secondary prizes. In one embodiment, the parallel matrices may be matched non-consecutively to win a prize. For example, matching column one and columns three through seven may provide the same top prize of a six of seven column match as matching columns one through six. Accordingly, the parallel matrices in this configuration are dependent on one another for the purpose of prize determination. However, the parallel matrices in this determination are not dependent on one another for the purpose of winning number selection as separate random number selection occurs for each parallel matrix.

In another embodiment, the parallel matrices have to be matched in a consecutive or ordered fashion to win a prize. For example, six consecutive columns such as columns one through six or columns two through seven out of seven columns may need to be matched to win the top prize.

In one embodiment, the parallel matrices each have identical sets of numbers in quantity. For example, the parallel matrices may each have eleven numbers. Those eleven numbers may identical for all of the parallel matrices, distinct for all of the parallel matrices, or distinct for only some of the parallel matrices. In yet another embodiment, at least some of the parallel matrices may have distinct sets of numbers in quantity. For example, the first column may have seven numbers, the second column may have eight numbers, the third column may have nine numbers, the fourth column may have ten numbers, the fifth column may have eleven numbers, and the fifth column may have twelve numbers. As another example, the first two columns may have seven numbers and the last three columns may have twelve numbers. In one configuration, the prizes may be awarded based on the difficulty of winning a specific column. For example, a player that has matched a column with twelve numbers may receive a higher prize total prize than having matched a column with only seven numbers, which is less difficult. Accordingly, the prizes may be a function of specific columns. The prize determination may be tabulated by adding the total number of columns matched and determining the type of match that occurred based on the quantity of numbers in the columns that are matched.

In another embodiment, the spot quantity is not selected by the player. For example, the gaming entity, e.g., a lottery, may have a predetermined quantity such as a one spot that the player needs to choose in quantity. The term predetermined as described herein may be utilized interchangeably with the term pre-established. The player selects the actual number, but can only select one number for each parallel matrix. In another embodiment, the player may have the opportunity to select between spot quantities for some parallel matrices and have a predetermined spot quantity for one or more other parallel matrices. For example, the player may be able to select between a one spot and a two spot for a first column, but may have to select a one spot for the second through fifth columns.

In an alternative embodiment, more than one number may be drawn for each parallel matrix. In this configuration, prizes may be larger for having more numbers matched in each parallel matrix. For example, a higher prize may be provided for matching two of two numbers drawn in a specific parallel matrix than one of two numbers drawn in that specific parallel matrix. However, a higher spot may result in a lesser prize. For example, matching two of two numbers for a three spot may result in a lesser prize than matching two of two numbers for a two spot. In one embodiment, the player may have the ability to determine not only the spot, but also the number of numbers that are randomly drawn. For example, a slot implementation of this configuration may allow the player to select both the spot quantity and the quantity of randomly drawn numbers for each parallel matrix. This implementation is not limited to slot machines and may be implemented in an Internet game, paper game, instant game, scratch-off game, etc.

FIG. 5 illustrates an example of an example of a number selection portion 500 of a wager slip for a hybrid game ticket that provides visual indicia to distinguish between parallel matrices. For example, lines may be utilized to distinguish between columns.

Figure 6:
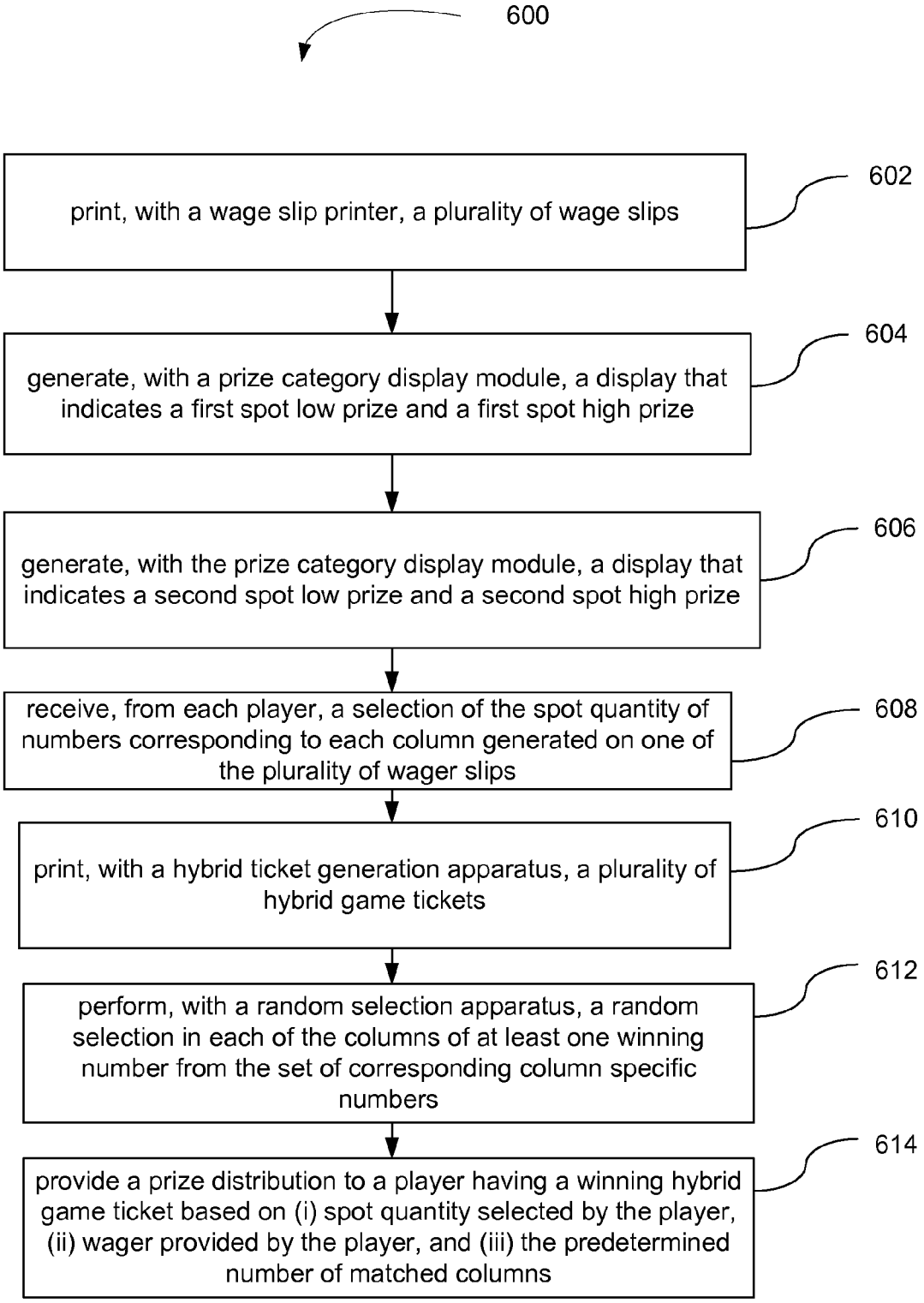
FIG. 6 illustrates a process that may be utilized to provide hybrid game tickets.

FIG. 6 illustrates a process 600 that may be utilized to provide hybrid game tickets. At a process block 602, the process 600 prints, with a wage slip printer, a plurality of wager slips corresponding to a hybrid game such that each wager slip indicates a plurality of columns that each has an identical set of corresponding column specific numbers that are sequential. Further, at a process block 604, the process 600 generates, with a prize category display module, a display that indicates a first spot low prize and a first spot high prize. The first spot low prize is won by a player providing a first wager and having a predetermined number of first spot matched columns, each first spot matched column having a match between a first spot quantity of numbers selected by the player from the set of corresponding column specific numbers and a quantity of randomly drawn numbers from the set of corresponding column specific numbers. The first spot high prize is won by a player providing a second wager and having the predetermined number of first spot matched columns. The second wager is greater than the first wager. In addition, at a process block 606, the process 600 generates, with the prize category display module, a display that indicates a second spot low prize and a second spot high prize, the second spot low prize being won by a player providing a first wager and having a predetermined number of second spot matched columns. Each second spot matched column has a match between a second spot quantity of numbers selected by the player from the set of corresponding column specific numbers and a quantity of randomly drawn numbers from the set of corresponding column specific numbers, the second spot high prize being won by a player providing a second wager and having the predetermined number of second spot matched columns. The second wager is greater than the first wager. The second spot high prize is less than the first spot high prize. At a process block 608, the process 600 also receives, from each player, a selection of the spot quantity of numbers corresponding to each column generated on one of the plurality of wager slips. Further, at a process block 610, the process 600 prints, with a hybrid ticket generation apparatus, a plurality of hybrid game tickets that are each based on player selections of numbers indicated on the plurality of wager slips. In addition, at a process block 612, the process 600 performs, with a random selection apparatus, a random selection in each of the columns of at least one winning number from the set of corresponding column specific numbers. Finally, at a process block 614, the process 600 provides a prize distribution to a player having a winning hybrid game ticket based on (i) spot quantity selected by the player, (ii) wager provided by the player, and (iii) the predetermined number of matched columns.

Figure 7:
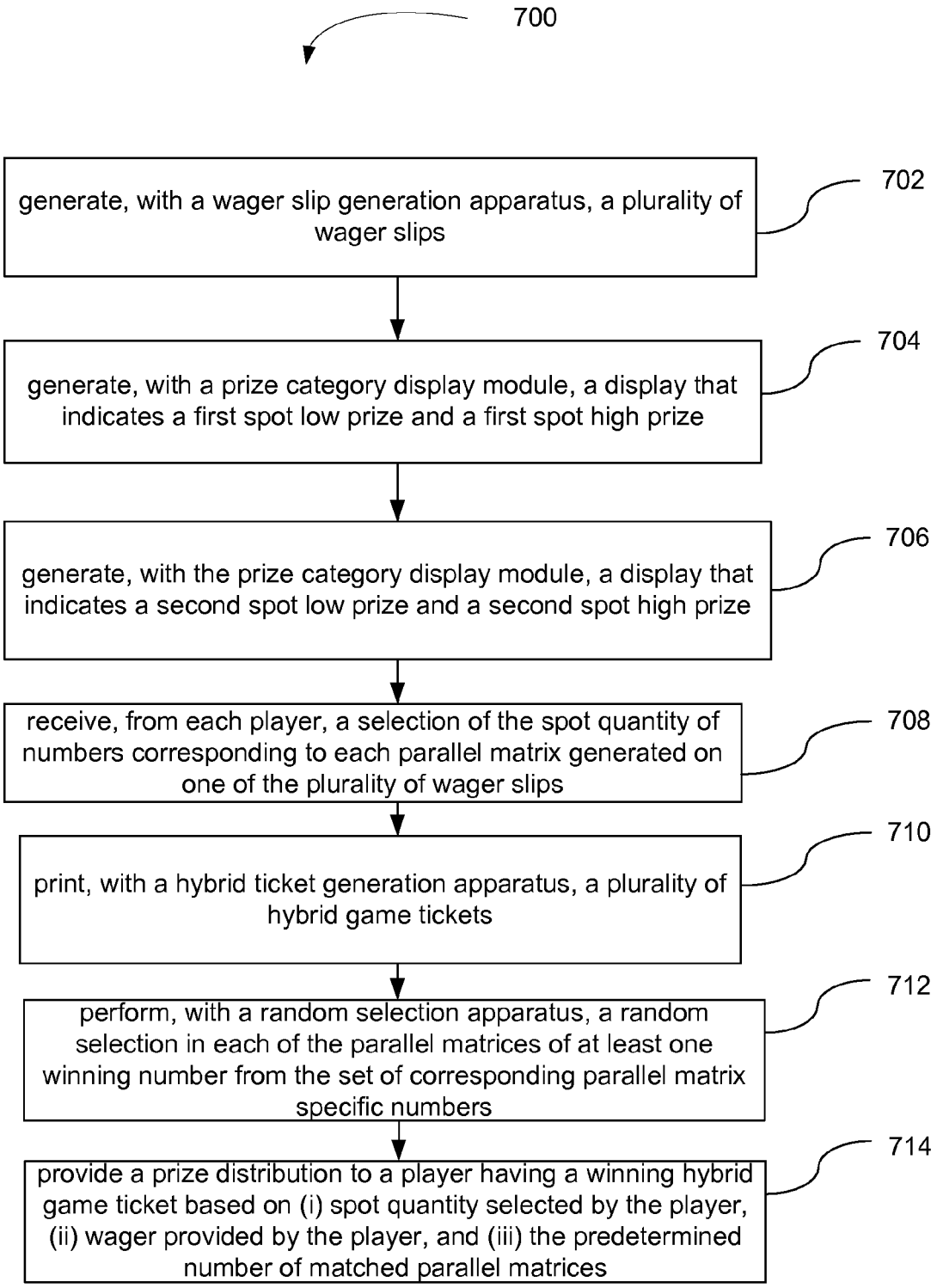
FIG. 7 illustrates another process that may be utilized to provide hybrid game tickets.

FIG. 7 illustrates another process 700 that may be utilized to provide hybrid game tickets. At a process block 702, the process 700 generates, with a wager slip generation apparatus, a plurality of wager slips corresponding to a hybrid game such that each wager slip indicates a plurality of parallel matrices that each has a set of corresponding parallel matrix specific numbers. Further, at a process block 704, the process 700 generates, with a prize category display module, a display that indicates a first spot low prize and a first spot high prize, the first spot low prize being won by a player providing a first wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. The first spot high prize is won by a player providing a second wager and having the predetermined number of first spot matched parallel matrices, the second wager being greater than the first wager. In addition, at a process block 706, the process 700 generates, with the prize category display module, a display that indicates a second spot low prize and a second spot high prize. The second spot low prize is won by a player providing the first wager and having a predetermined number of second spot matched parallel matrices. Each second spot matched column has a match between a second spot quantity of numbers selected by the player from the set of corresponding parallel matrix specific numbers and a quantity of randomly drawn numbers from the set of corresponding parallel matrix specific numbers. The second spot high prize is won by a player providing a second wager and having the predetermined number of second spot matched parallel matrices. The second wager is greater than the first wager, the second spot high prize being less than the first spot high prize. At a process block 708, the process 700 also receives, from each player, a selection of the spot quantity of numbers corresponding to each parallel matrix generated on one of the plurality of wager slips. In addition, at a process block 710, the process 700 prints, with a hybrid ticket generation apparatus, a plurality of hybrid game tickets that are each based on player selections of numbers indicated on the plurality of wager slips. At a process block 712, the process 700 also performs, with a random selection apparatus, a random selection in each of the parallel matrices of at least one winning number from the set of corresponding parallel matrix specific numbers. Further, at a process block 714, the process 700 provides a prize distribution to a player having a winning hybrid game ticket based on (i) spot quantity selected by the player, (ii) wager provided by the player, and (iii) the predetermined number of matched parallel matrices.

The term number of parallel matrices having matches as described herein is intended to include the number zero. In other words, a prize may be awarded for having matched zero columns. For a match of zero columns to occur, the spots selected would have to be distinct, either partially or fully, from the numbers drawn per column.

Figure 8:
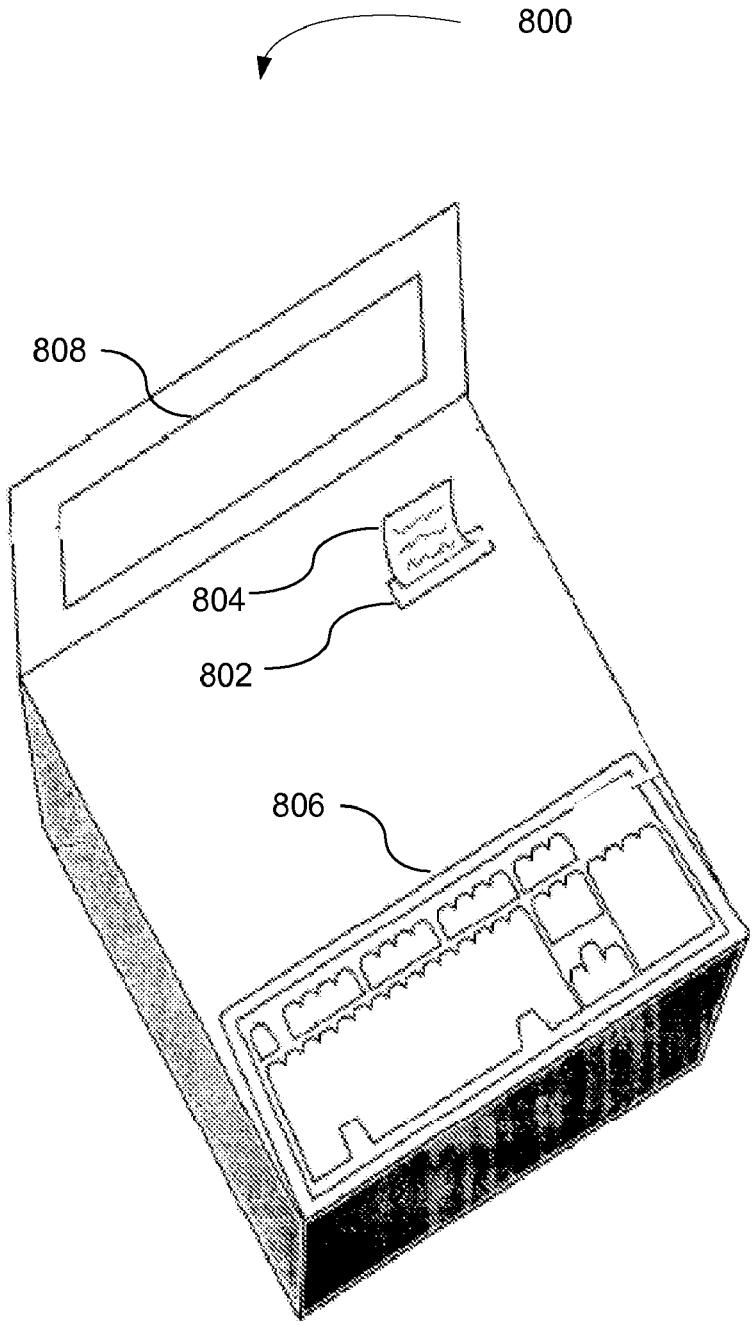
FIG. 8 illustrates a hybrid game ticket dispensing machine.

FIG. 8 illustrates a hybrid game ticket dispensing machine 800. An input console 806 may receive data from the player, a lottery operator, or lottery vendor of a selection of a spot quantity and numbers for each parallel matrix. Further, a ticket printer 802 prints the hybrid game ticket 804. The display console 808 may display information regarding the hybrid game prize structure and/or payment information. A payment receptor may also be utilized with the hybrid game ticket dispensing machine 800 to receive payment for play of the hybrid game.

Figure 9:
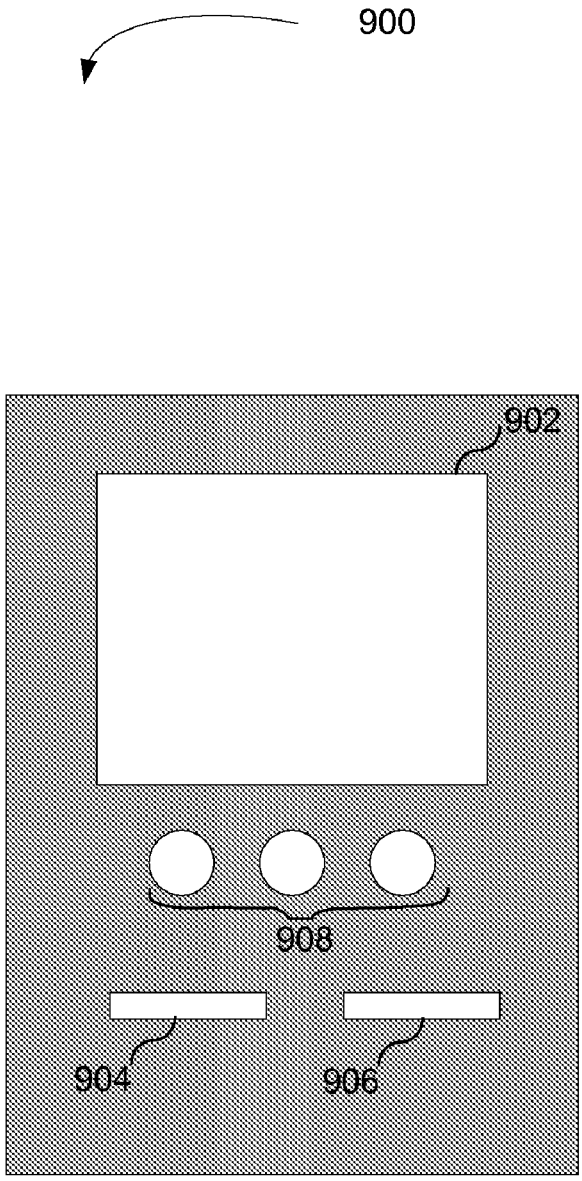
FIG. 9 illustrates a hybrid game electronic apparatus that may be utilize to play an electronic version of the hybrid game.

FIG. 9 illustrates a hybrid game electronic apparatus 900 that may be utilize to play an electronic version of the hybrid game. An input console 908 may receive data from the player, a lottery operator, or lottery vendor of a selection of a spot quantity and numbers for each parallel matrix. Further, a ticket printer 904 prints the hybrid game ticket. A payment receptor 904 may receive payment for play of the hybrid game. The display console 902 may display information regarding the hybrid game prize structure and/or payment information.

In one embodiment, the ticket printer 904 is not utilized because the electronic version of the hybrid game may be paperless, i.e., virtual. For example, a virtual ticket may be displayed on the display console 902 for Internet-based play, web-based play, mobile devices, interactive television, or the like. Further, the display console 902 may be a monitor screen for a monitor game.

Figure 10:
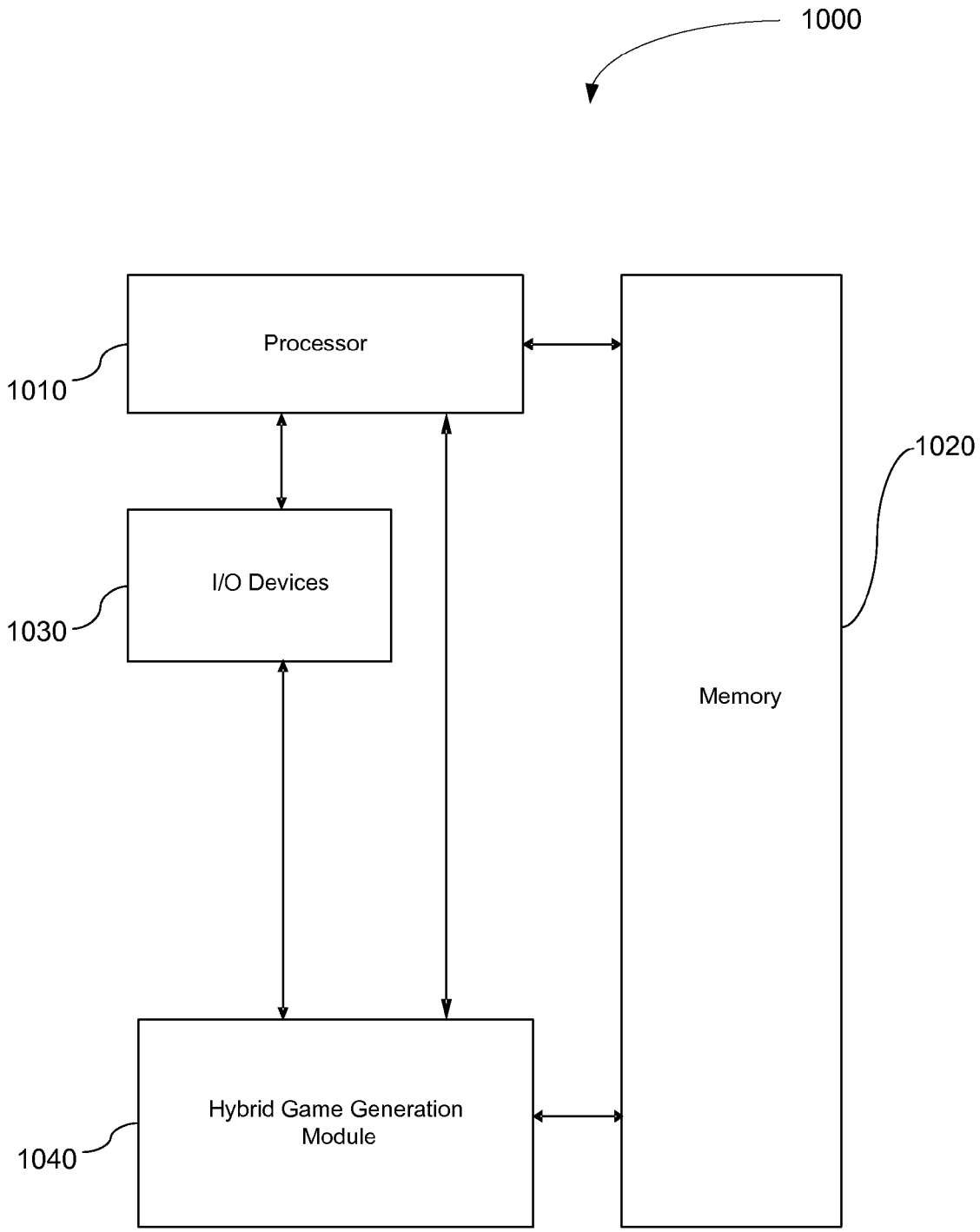
FIG. 10 illustrates a block diagram of a station or system that provides hybrid game tickets.

FIG. 10 illustrates a block diagram of a station or system 1000 that provides hybrid game tickets. In one embodiment, the station or system 1000 is implemented utilizing a general purpose computer or any other hardware equivalents. Thus, the station or system 1000 comprises a processor 1010, a memory 1020, e.g., random access memory ("RAM") and/or read only memory (ROM), a hybrid game generation module 1040, and various input/output devices 1030, (e.g., audio/video outputs and audio/video inputs, storage devices, including but not limited to, a tape drive, a floppy drive, a hard disk drive or a compact disk drive, a receiver, a transmitter, a speaker, a display, an image capturing sensor, e.g., those used in a digital still camera or digital video camera, a clock, an output port, a user input device (such as a keyboard, a keypad, a mouse, and the like, or a microphone for capturing speech commands)).

It should be understood that the hybrid game generation module 1040 may be implemented as one or more physical devices that are coupled to the processor 1010. For example, the hybrid game generation module 1040 may include a plurality of modules. Alternatively, the hybrid game generation module 1040 may be represented by one or more software applications (or even a combination of software and hardware, e.g., using application specific integrated circuits (ASIC)), where the software is loaded from a storage medium, (e.g., a magnetic or optical drive, diskette, or non-volatile memory) and operated by the processor in the memory 1020 of the computer. As such, the hybrid game generation module 1040 (including associated data structures) of the present disclosure may be stored on a computer readable medium, e.g., RAM memory, magnetic or optical drive or diskette and the like.

Figure 11:
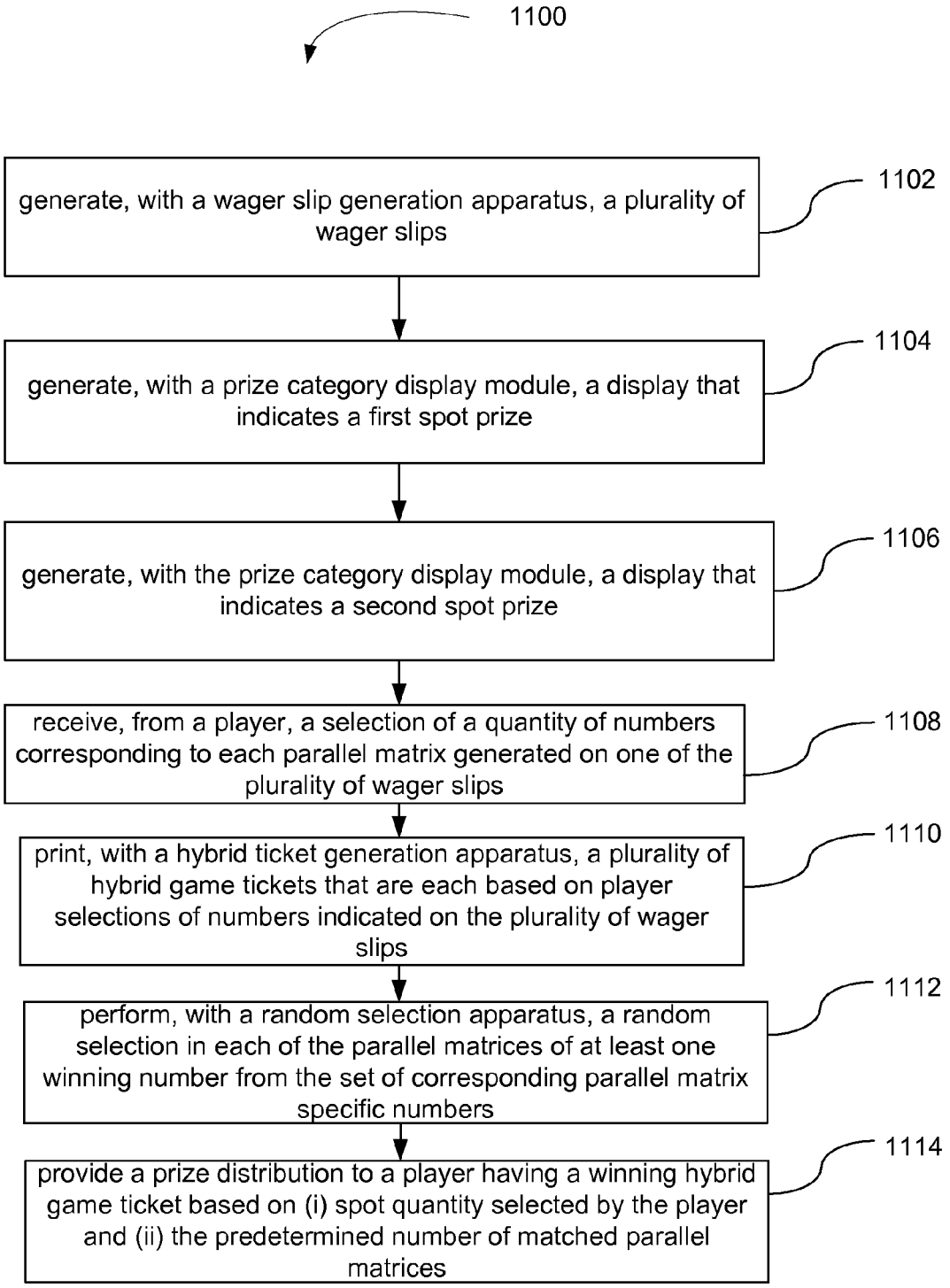
FIG. 11 illustrates another process that may be utilized to generate hybrid game tickets.

FIG. 11 illustrates another process 1100 that may be utilized to generate hybrid game tickets. At a process block 1102, the process 1100 generates, generates, with a wager slip generation apparatus, a plurality of wager slips corresponding to a hybrid game such that each wager slip indicates a plurality of parallel matrices that each has a set of corresponding parallel matrix specific numbers. Further, at a process block 1104, the process 1100 generates, with a prize category display module, a display that indicates a first spot prize that is won by a player providing a wager and having a predetermined number of first spot matched parallel matrices. Each first spot matched parallel matrix has a match between a first spot quantity of numbers selected by the player from the set of corresponding parallel matrix specific numbers and a quantity of randomly drawn numbers from the set of corresponding parallel matrix specific numbers. In addition, at a process block 1106, the process generates, with the prize category display module, a display that indicates a second spot prize that is won by a player providing the wager and having a predetermined number of second spot matched parallel matrices. Each second spot matched parallel matrix has a match between a second spot quantity of numbers selected by the player from the set of corresponding parallel matrix specific numbers and a quantity of randomly drawn numbers from the set of corresponding parallel matrix specific numbers. The second spot quantity is greater than the first spot quantity, the second spot quantity prize corresponding to a quantity of matched parallel matrices being less than the first spot quantity prize corresponding to the quantity of matched matrices. At a process block 1108, the process 1100 also receives, from a player, a selection of a quantity of numbers corresponding to each parallel matrix generated on one of the plurality of wager slips, the quantity of numbers being based on the first spot quantity or the second spot quantity. Further, at a process block 1110, the process 1100 prints, with a hybrid ticket generation apparatus, a plurality of hybrid game tickets that are each based on player selections of numbers indicated on the plurality of wager slips. In addition, at a process block 1112, the process 1100 performs, with a random selection apparatus, a random selection in each of the parallel matrices of at least one winning number from the set of corresponding parallel matrix specific numbers. At a process block 1114, the process 1100 also provides a prize distribution to a player having a winning hybrid game ticket based on (i) spot quantity selected by the player and (ii) the predetermined number of matched parallel matrices.

Figure 12:
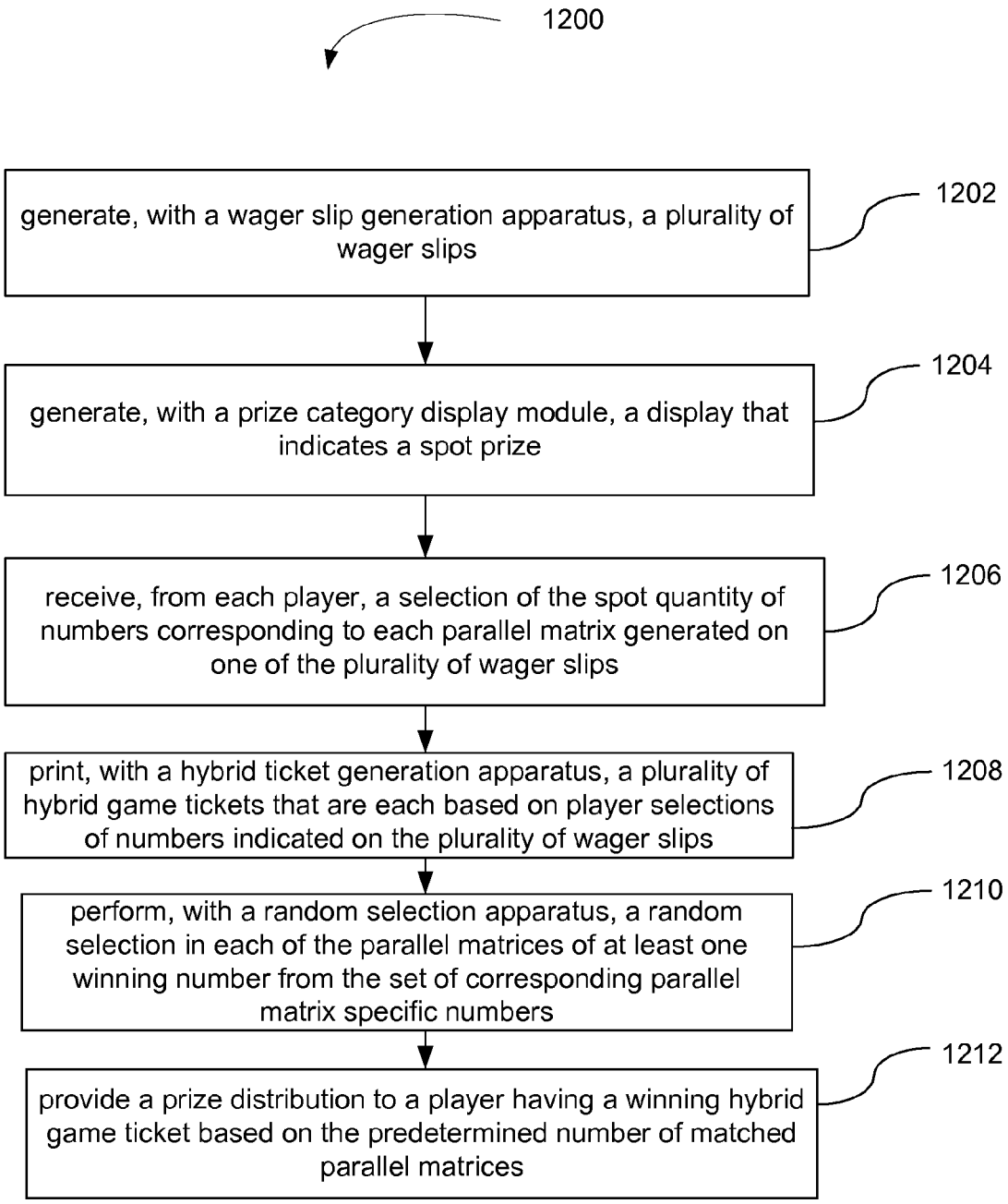
FIG. 12 illustrates another process that may be utilized to generate hybrid game tickets.

FIG. 12 illustrates another process 1200 that may be utilized to generate hybrid game tickets. At a process block 1202, the process 1200 generates, with a wager slip generation apparatus, a plurality of wager slips corresponding to a hybrid game such that each wager slip indicates a plurality of parallel matrices that each has a set of corresponding parallel matrix specific numbers. Further, at a process block 1204, the process 1200 generates, with a prize category display module, a display that indicates a spot prize that is won by a player having a predetermined number of matched parallel matrices. Each matched parallel matrix having a match between a spot quantity of numbers selected by the player from the set of corresponding parallel matrix specific numbers and a quantity of randomly drawn numbers from the set of corresponding parallel matrix specific numbers. In addition, at a process block 1206, the process 1200 receives, from each player, a selection of the spot quantity of numbers corresponding to each parallel matrix generated on one of the plurality of wager slips. At a process block 1208, the process 1200 also prints, with a hybrid ticket generation apparatus, a plurality of hybrid game tickets that are each based on player selections of numbers indicated on the plurality of wager slips. Further, at a process block 1210, the process 1200 performs, with a random selection apparatus, a random selection in each of the parallel matrices of at least one winning number from the set of corresponding parallel matrix specific numbers. In addition, at a process block 1212, the process 1200 provides a prize distribution to a player having a winning hybrid game ticket based on the predetermined number of matched parallel matrices.

FIG. 13 illustrates an expected payout table 1300. In one embodiment, a process of controlling and managing expected prize payout may be utilized to aggregate expected prize payouts across a plurality of wager amounts and a plurality of spot quantities to offer featured prize categories. The expected payout table 1300 is an example that is based on equal distribution of the alternatives illustrated in FIG. 13. The featured prize categories carry a higher expected payout than the maximum expected prize payout for the game as a whole. In one configuration, the featured prize may carry a higher expected payout that requires a maximum wager amount, which thereby increases the average wager amount in the hybrid game. The higher expected payout of featured prizes is offset against relatively lesser expected payout averages for minimum wager amounts and other spot quantity wagers that do not offer the featured or grand prize.

The expected payout table 1300 has a spot field 1302, a first wager field 1304, a second wager field 1306, and an average expected payout field 1308. The spot field 1302 has as examples a one spot 1310, a two spot 1312, a three spot 1314, and a four spot 1316. As examples, the first wager field 1304 may indicate a first wager of one dollar and the second wager field 1306 may indicate a second wager of two dollars. A first wager one spot expected payout 1318 may be fifty two percent and a second wager one spot expected payout 1326 may be fifty six percent to result in a one spot average expected payout 1334 of fifty four percent. Further, a first wager two spot expected payout 1320 may be forty eight percent and a second wager two spot expected payout 1328 may be fifty two percent to result in a two spot average expected payout 1336 of fifty percent. In addition, a first wager three spot expected payout 1322 may be forty seven percent and a second wager two spot expected payout 1330 may be forty nine percent to result in a three spot average expected payout 1338 of forty eight percent. Further, a first wager four spot expected payout 1324 may be forty seven percent and a second wager two spot expected payout 1332 may be forty nine percent to result in a four spot average expected payout 1340 of forty eight percent. The second wager one spot expected payout 1326 of fifty six percent is an example of the expected payout for a featured or grand prize.

In another embodiment, the hybrid game described herein may be utilized with a supplemental game. Any of the configurations described herein may be utilized with the supplemental game. The configuration for the supplemental game may be implemented to provide for a paper ticket, an electronic ticket, a virtual ticket, a game played on the Internet or any other wireless medium, a slot machine game, an online instant game, a scratch-off instant game, a peel-off instant game, an online drawing game, etc. The configuration for the hybrid game may also be implemented to provide for a paper ticket, an electronic ticket, a virtual ticket, a game played on the Internet or any other wireless medium, a slot machine game, an online instant game, a scratch-off instant game, a peel-off instant game, an online drawing game, etc.

Figure 14:
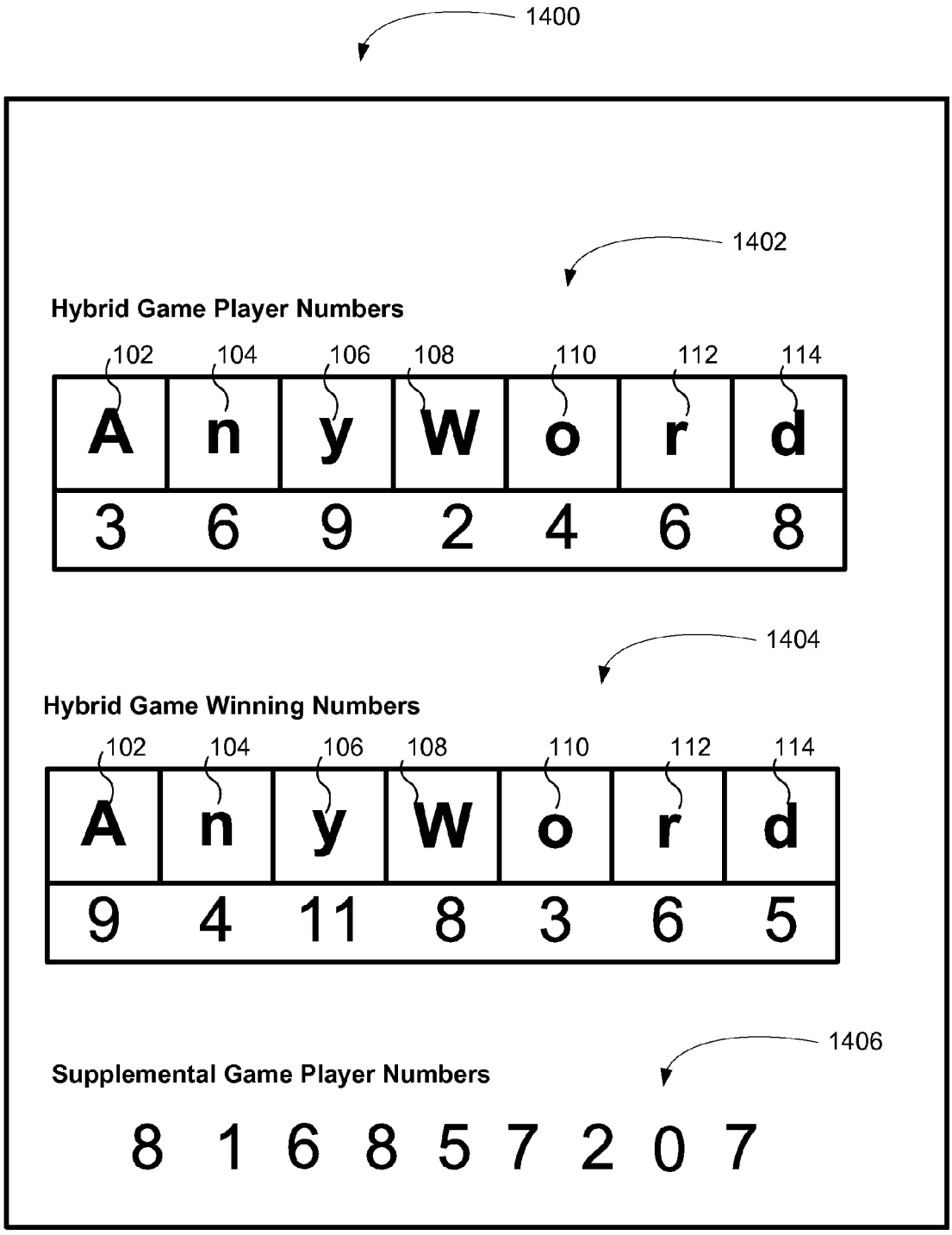
FIG. 14 illustrates an example of a hybrid game ticket that provides entry into an instant configuration of the hybrid game in addition to a daily drawing of the supplemental game.

FIG. 14 illustrates an example of a hybrid game ticket 1400 that provides entry into an instant configuration of the hybrid game in addition to a daily drawing of the supplemental game. The hybrid game ticket 1400 includes a set of hybrid game player numbers 1402, a set of hybrid game winning numbers 1404, and a set of supplemental game player numbers 1406. The hybrid game operates as provided for in FIG. 3B. Accordingly, the player instantly knows the outcome of the hybrid game. However, the player does not instantly know the outcome of the supplemental game. The player receives the set of supplemental game player numbers 1406 that are utilized by the player to determine whether a match exists in a separate and subsequent drawing for the supplemental game. As an example, the supplemental game may be a daily drawing game for which a random drawing is performed at the end of the day. The set of supplemental game player numbers 1406 may be a set of numbers, digits, etc. Alternatively, the set of hybrid game player numbers 1402 and/or the set of supplemental game player numbers 1406 may be indicia such as symbols rather than numbers that can be matched with randomly drawn indicia.

The configuration described in FIG. 14 is intended only as an example. In one embodiment, the hybrid game and the supplemental game occur at different predetermined time intervals. For example, the hybrid game drawing illustrated in FIG. 14 occurs at a first predetermined time interval that is instantaneous whereas the supplemental game occurs at a second predetermined time intervals that is daily. These predetermined time intervals may be different from the predetermined intervals provided herein. For example, the hybrid game may a daily drawing game in which the hybrid game winning numbers are not provided on the hybrid game ticket 1400, but rather are randomly drawn at the end of the day, and the supplemental game may be a weekly drawing game. In that instance, neither the hybrid game winning numbers nor the supplemental game winning numbers are printed on the ticket. Alternatively, the hybrid game may be a drawing game and the supplemental game may be an instant game. In one embodiment, the hybrid game and the supplemental game are different types of games. In another embodiment, the hybrid game and the supplemental game are the same types of games. In one embodiment, the hybrid game and the supplemental game have different predetermined time intervals. In another embodiment, the hybrid game and the supplemental game have the same predetermined time intervals.

In one embodiment, the supplemental game prize may be a full match prize or a partial match prize depending on the type of match the player has with a supplemental game randomly drawn number. For example, a player matching nine out of nine digits may win a full match prize whereas a player matching eight out of nine digits may win a partial match prize. In one embodiment, the full match supplemental game prize is a must go prize and the partial match supplemental game prize is a non-must go prize. The term must go prize is intended to mean that a prize must be won for a particular drawing because the winning number is selected only from the player numbers that are purchased. The term non-must go prize is intended to mean that a prize may not be won for a particular drawing because the set of winning numbers is selected from all possible player numbers irrespective of whether the player numbers have been purchased or not. In another embodiment, the full match supplemental game prize is a non-must go prize and the partial match supplemental game prize is a must go prize. In one embodiment, the full match supplemental game prize is a must go prize and the partial match supplemental game prize is a must go prize. In another embodiment, the full match supplemental game prize is a non-must go prize and the partial match supplemental game prize is a non-must go prize.

In another embodiment, the hybrid game and/or the supplemental game may be predetermined outcome games rather than randomly generated outcome games. For example, the one millionth ticket sold may be a grand prize winner. That predetermined outcome is different than a random outcome which allows any ticket to be a winning ticket.

FIG. 15 illustrates a hybrid game and supplemental game prize structure 1500. The wagers that would typically be utilized for the hybrid game alone may be increased to fund the supplemental game prize. For example, the wagers for the hybrid game prize configuration in FIG. 2 were ten dollars and two dollars. Those wagers may be increased by one dollar to eleven dollars and three dollars so that the extra revenue may be utilized to help fund the supplemental game prize. Accordingly, the one spot hybrid game prize configuration 1502 and the two spot hybrid game prize configuration 1504 are similar to the prize configurations seen in FIG. 2 except for the increased wagers. Further, a supplemental game prize configuration 1506 illustrates a first wager 1512 and a second wager 1514. The first wager 1512 and the second wager 1514 are the same wagers that are utilized for the hybrid game. In other words, the player's wager provides entry into both the hybrid game and the supplemental game. In one embodiment, the player must enter both the hybrid game and the supplemental game. For example, the player has to make a three dollar or an eleven dollar wager. In another embodiment, the player has a choice of making or not making an increased wager. For example, the player may be able to make a two dollar wager or a ten dollar wager for entry into the hybrid game, or the player may optionally be able to make a three dollar wager or an eleven dollar wager for entry into the hybrid game and the supplemental game.

In one embodiment, the supplemental game prize configuration provides for a partial match field 1508 and a full match field 1510. For example, a player may win a partial match prize 1516 for ten thousand dollars or a full match prize 1518 of one million dollars by making an eleven dollar wager whereas the player may win a partial match prize 1520 of one hundred dollars or a full match prize 1522 of one hundred thousand dollars by making a three dollar wager. In another embodiment, the supplemental game prize configuration may provide only a full match prize. In yet another embodiment, the supplemental game prize does not vary based on the wager provided by the player. For example, the player may have the hybrid game prize affected by wager, but the supplemental game prize would be one million dollars irrespective of whether the player makes an eleven dollar wager or a three dollar wager. In that instance, the supplemental game prize is uniform across price points.

Figure 16:
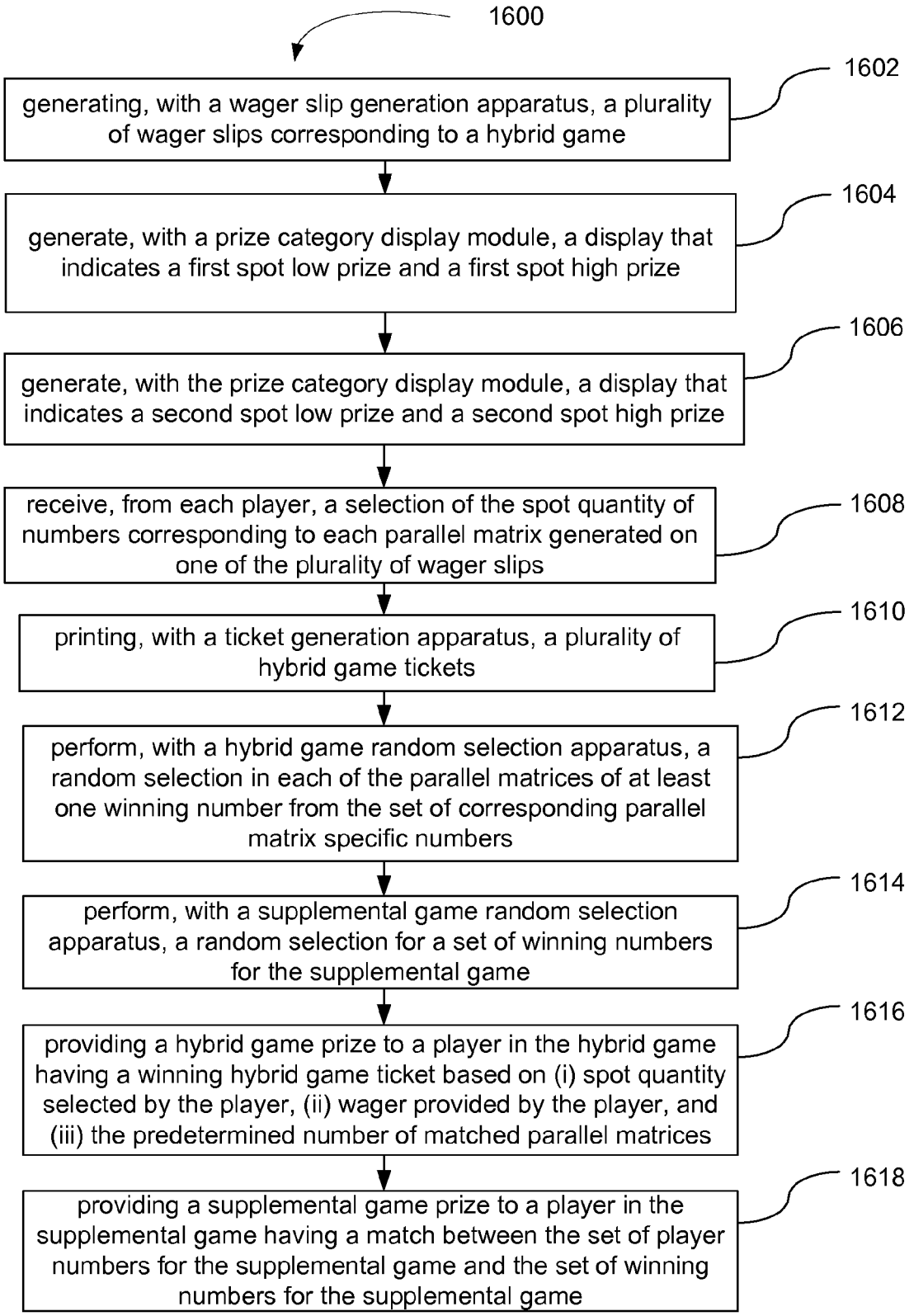
FIG. 16 illustrates a process that may be utilized to provide a hybrid game and a supplemental game.

FIG. 16 illustrates a process 1600 that may be utilized to provide a hybrid game and a supplemental game. At a process block 1602, the process 1600 generates, with a wager slip generation apparatus, a plurality of wager slips corresponding to a hybrid game such that each wager slip indicates a plurality of parallel matrices that each has a set of corresponding parallel matrix specific numbers. Further, at a process block 1604, the process 1600 generates, with a prize category display module, a display that indicates a first spot low prize and a first spot high prize, the first spot low prize being won by a player providing a first wager and having a predetermined number of first spot matched parallel matrices. Each first spot matched parallel matrix having a match between a first spot quantity of numbers selected by the player from the set of corresponding parallel matrix specific numbers and a quantity of randomly drawn numbers from the set of corresponding parallel matrix specific numbers. The first spot high prize is won by a player providing a second wager and having the predetermined number of first spot matched parallel matrices, the second wager being greater than the first wager. The first wager and the second wager each additionally provide entry for the player in a supplemental game. Further, at a process block 1604, the process 1600 generates, with the prize category display module, a display that indicates a second spot low prize and a second spot high prize. The second spot low prize is won by a player providing the first wager and having a predetermined number of second spot matched parallel matrices. Each second spot matched parallel matrix has a match between a second spot quantity of numbers selected by the player from the set of corresponding parallel matrix specific numbers and a quantity of randomly drawn numbers from the set of corresponding parallel matrix specific numbers. The second spot high prize is won by a player providing a second wager and having the predetermined number of second spot matched parallel matrices, the second wager being greater than the first wager. The second spot high prize is less than the first spot high prize. In addition, at a process block 1606, the process 1600 receives, from each player, a selection of the spot quantity of numbers corresponding to each parallel matrix generated on one of the plurality of wager slips. At a process block 1608, the process 1600 also receives, from each player, one of the first wager or the second wager. Further, at a process block 1610, the process 1600 prints, with a ticket generation apparatus, a plurality of hybrid game tickets that are each based on player selections of numbers indicated on the plurality of wager slips and a set of player numbers for the supplemental game. In addition, at a process block 1612, the process 1600 performs, with a hybrid game random selection apparatus, a random selection in each of the parallel matrices of at least one winning number from the set of corresponding parallel matrix specific numbers. Further, at a process block 1614, the process 1600 performs, with a supplemental game random selection apparatus, a random selection for a set of winning numbers for the supplemental game. The supplemental game random selection apparatus is distinct from the hybrid game random selection apparatus. Further, at a process block 1616, the process 1600 provides a hybrid game prize to a player in the hybrid game having a winning hybrid game ticket based on (i) spot quantity selected by the player, (ii) wager provided by the player, and (iii) the predetermined number of matched parallel matrices. In addition, at a process block 1618, the process 1600 provides a supplemental game prize to a player in the supplemental game having a match between the set of player numbers for the supplemental game and the set of winning numbers for the supplemental game.

The supplemental game is not limited to being utilized with the hybrid game. A primary game may be utilized with the supplemental game. The configuration for the supplemental game may be implemented to provide for a paper ticket, an electronic ticket, a virtual ticket, a game played on the Internet or any other wireless medium, a slot machine game, an online instant game, a scratch-off instant game, a peel-off instant game, an online drawing game, etc. The configuration for the primary game may also be implemented to provide for a paper ticket, an electronic ticket, a virtual ticket, a game played on the Internet or any other wireless medium, a slot machine game, an online instant game, a scratch-off instant game, a peel-off instant game, an online drawing game, etc.

Figure 17:
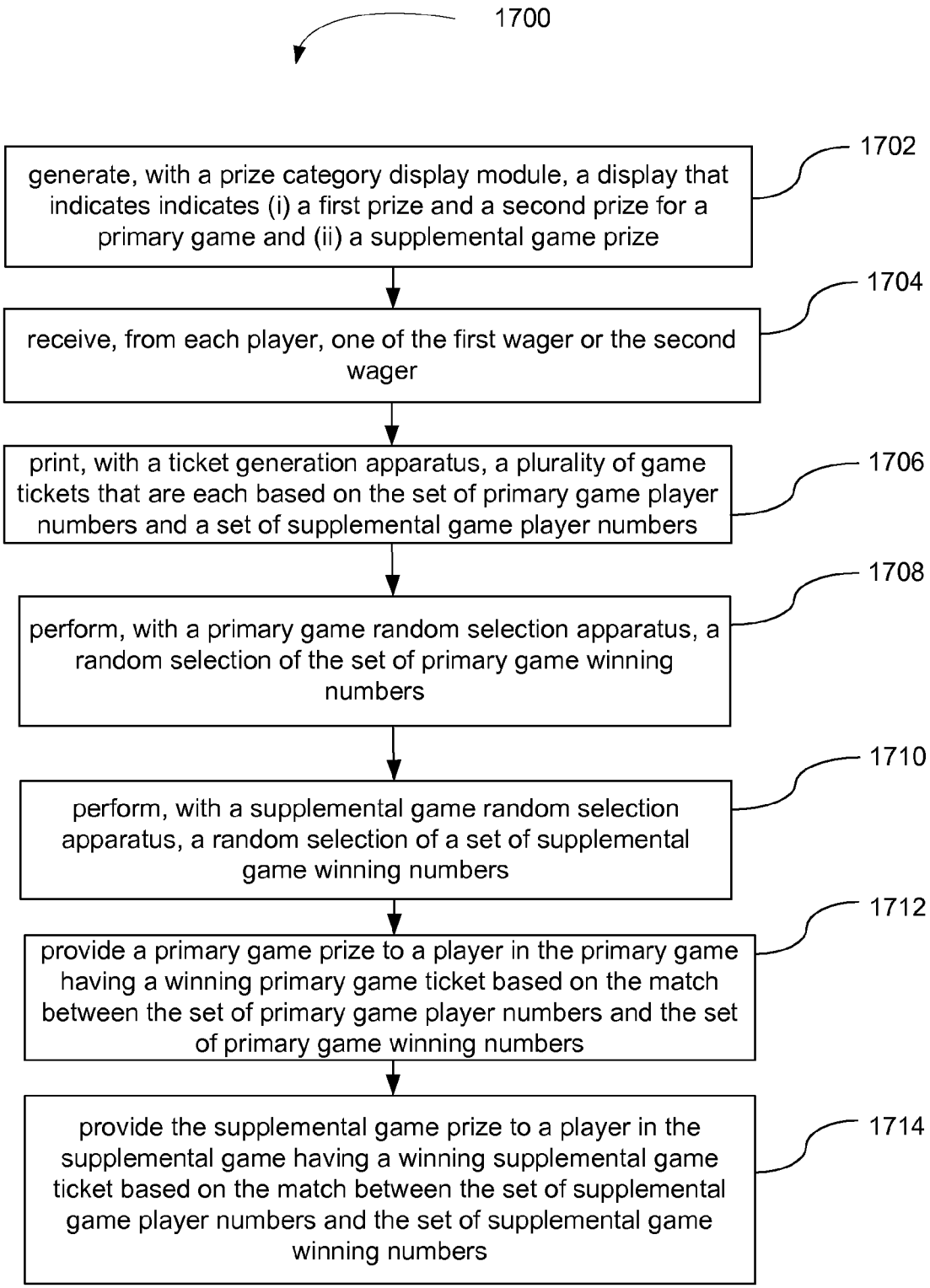
FIG. 17 illustrates a process that may be utilized to provide a primary game and a supplemental game.

FIG. 17 illustrates a process 1700 that may be utilized to provide a primary game and a supplemental game. At a process block 1702, the process 1700 generates, with a prize category display module, a display that indicates (i) a first prize and a second prize for a primary game and (ii) a supplemental game prize. The first prize is won by a player that provides a first wager and has a match between a set of primary game player numbers and a set of primary game winning numbers. The second prize is won by a player that provides a second wager and has a match between the set of primary game player numbers and the set of primary game winning numbers, the second wager being greater than the first wager, the second prize being greater than the first prize. Each of the first wager and the second wager additionally provide entry into a supplemental game corresponding to the supplemental game prize. Further, at a process block 1704, the process 1700 receives, from each player, one of the first wager or the second wager. In addition, at a process block 1706, the process 1700 prints, with a ticket generation apparatus, a plurality of game tickets that are each based on the set of primary game player numbers and a set of supplemental game player numbers. At a process block 1708, the process 1700 performs, with a primary game random selection apparatus, a random selection of the set of primary game winning numbers. At a process block 1710, the process 1700 also performs, with a supplemental game random selection apparatus, a random selection of a set of supplemental game winning numbers. The supplemental game random selection apparatus is distinct from the primary game random selection apparatus. Further, at a process block 1712, the process 1700 provides a primary game prize to a player in the primary game having a winning primary game ticket based on the match between the set of primary game player numbers and the set of primary game winning numbers. In addition, at a process block 1714, the process 1700 provides the supplemental game prize to a player in the supplemental game having a winning supplemental game ticket based on the match between the set of supplemental game player numbers and the set of supplemental game winning numbers.

In one embodiment, the configurations described herein may provide a player with a single ticket for both the hybrid game and the supplemental game. In another embodiment, the configurations described herein may provide a player with two separate tickets for the hybrid game and the supplemental game. In one embodiment, the configurations described herein may provide a player with a single ticket for both the primary game and the supplemental game. In another embodiment, the configurations described herein may provide a player with two separate tickets for the primary game and the supplemental game.

In one embodiment, the configurations described herein may utilize a single random selection apparatus to perform the random selections for both the hybrid game and the supplemental game. In another embodiment, the configurations described herein may utilize a hybrid random selection apparatus to perform the random selection for the hybrid game and a supplemental random selection apparatus to perform the random selection for the supplemental game such that the hybrid random selection apparatus is distinct from the supplemental random selection apparatus. In one embodiment, the configurations described herein may utilize a single random selection apparatus to perform the random selections for both the primary game and the supplemental game. In another embodiment, the configurations described herein may utilize a primary random selection apparatus to perform the random selection for the primary game and a supplemental random selection apparatus to perform the random selection for the supplemental game such that the primary random selection apparatus is distinct from the supplemental random selection apparatus.

In yet another, the configurations described herein may be utilized as a combined base game and add-on game with a supplemental game. FIG. 18 illustrates a combined base game and add-on game with a supplemental game prize structure 1800. A match field 1802 indicates different types of matches. Further, a first price category field 1804 indicates a first price category of one dollar, a second price category field 1806 indicates a second price category of two dollars, and a third price category field 1808 indicates a third price category of three dollars. A player can play the base game by providing a wager from the first price category. For example, a player providing a wager of one dollar allows the player to win a base game prize 1818 for a full match 1818 of six of six. The base game prize 1818 may be a jackpot prize. For instance, the jackpot prize may be a progressive prize that grows at least in part based on ticket sales. The one dollar wager also allows the player to win a variety of partial matches if a full match is not obtained, e.g., a five of six partial match prize 1822 of one thousand dollars for a five of six partial match 1812, a four of six partial match prize 1828 of one hundred dollars for a four of six partial match 1814, or a three of six partial match prize 1834 of ten dollars for a three of six partial match 1816. By providing an additional wager, the player may player an add-on game that is based on the same drawing as the base game and a supplemental game that is based on a different drawing than the base game. For example, the player can provide an additional wager of one dollar for a total wager of two dollars from the second price category 1806 to have an opportunity at winning the base game jackpot prize 1818 and the opportunity at winning the supplemental game prize 1820. A separate random selection occurs for the base game and the supplemental game. These random selections may occur at the same or different predetermined time intervals. The player may win neither the base game prize 1818 nor the supplemental prize 1820, one of these prizes, or both of these prizes depending on the matches for the different random selections. The two dollar wager also allows the player to win a variety of partial matches if a full match is not obtained in addition to the supplemental prize 1820, e.g., a five of six partial match prize 1824 of two thousand dollars and the supplemental prize 1820 for a five of six partial match 1812, a four of six partial match prize 1830 of two hundred dollars and the supplemental prize 1820 for a four of six partial match 1814, or a three of six partial match prize 1836 of twenty dollars and the supplemental prize 1820 for a three of six partial match 1816. The player may win neither the partial match nor the supplemental prize 1820, one of these prizes, or both of these prizes depending on the matches for the different random selections. The additional wager of one dollar is an example of a linear increase in partial match prize value that the add-on game provides to the base game. The add-on game prize values are double the base game prize values for double the wager for the partial match prize values. For example, an additional dollar adds an additional one thousand dollars in prize value for a five of six match 1812, an additional one hundred dollars in prize value for a four of six match 1814, and an additional ten dollars in prize value for a three of six match 1816. In this configuration, the linear increase is utilized only for the partial match prizes and the jackpot value is constant irrespective of price category. In an alternative configuration, the jackpot prize may also increase linearly based on wager amount.

In addition, the player can provide an additional wager of two dollars for a total wager of three dollars from the third price category 1808 to have an opportunity at winning the base game jackpot prize 1818 and the opportunity at winning the supplemental game prize 1820. The player has the same opportunity at winning the base game jackpot prize 1818 and the opportunity at winning the supplemental game prize 1820 as the player had for providing an additional wager of one dollar for a total wager of two dollars form the second price category 1806. The three dollar wager allows the player to win a variety of partial matches if a full match is not obtained in addition to the supplemental prize 1820, e.g., a five of six partial match prize 1826 of five thousand dollars and the supplemental prize 1820 for a five of six partial match 1812, a four of six partial match prize 1832 of five hundred dollars and the supplemental prize 1820 for a four of six partial match 1814, or a three of six partial match prize 1838 of ten dollars and the supplemental prize 1820 for a three of six partial match 1816. The player may win neither the partial match nor the supplemental prize 1820, one of these prizes, or both of these prizes depending on the matches for the different random selections. The additional wager of two dollars is an example of a non-linear increase in partial match prize value that the add-on game provides to the base game. The add-on game prize values are more than triple the base game prize values for only triple the wager for the partial match prize values. For example, an additional two dollars adds an additional four thousand dollars in prize value for a five of six match 1812, an additional four hundred dollars in prize value for a four of six match 1814, and an additional forty dollars in prize value for a three of six match 1816. In this configuration, the non-linear increase is utilized only for the partial match prizes and the jackpot value is constant irrespective of price category. In an alternative configuration, the jackpot prize may also increase non-linearly based on wager amount.

In one embodiment, the higher wagers may provide increased frequency of supplemental game player numbers for the supplemental game. For example, the player may obtain only one set of supplemental game player numbers for purchasing a ticket from the second price category 1806 for two dollars, but may obtain three sets of supplemental game player numbers for purchasing a ticket from the third price category 1808 for three dollars. Accordingly, the player has three opportunities at winning the supplemental game prize by purchasing a ticket from the three dollar price category rather than only one opportunity by purchasing a ticket from the two dollar price category. The frequency increase may be a linear increase or a non-linear increase in the number of sets of supplemental game player numbers received for a given price category. The numerical values illustrated in FIG. 18 for price categories and prize values are intended only as examples.

In one embodiment, the base game may have full or partial matches, but the supplemental game prize is a prize given only for a full match. That supplemental game prize may be given irrespective of whether a player obtained a full match, a partial match, or no match in the base game. In another embodiment, the supplemental game prize value is based on the wager amount. Accordingly, a player may obtain a higher portion of a supplemental game prize for a higher wager. In yet another embodiment, the supplemental game may have different supplemental prize amounts based on a full match or a partial match in the supplemental game. Further, in one embodiment, the supplemental game may have different supplemental prize amounts based on a full match or a partial match in the supplemental game and those amounts may be higher if the player places a higher wager.

In one embodiment, the supplemental game can only be played by a purchase of both the base game and the add-on game. In another embodiment, the supplemental game may be played for a premium wager without purchasing entry into the base game and the add-on game. In one configuration, the premium wager is established such that the premium wager is the same wager for entry into both the base game and the add-on game. For example, the premium wager can be established to be two dollars, which is the minimal wager for entry into the base game and add-on game seen in FIG. 18. Accordingly, the player that wants to play the supplemental game independently of the base game and the add-on game is incentivized to provide the same wager for the base game and the add-on game, which also provides entry into the supplemental game. As an example, the base game and add-on game may be lottery games, and the supplemental game may be a raffle game. A player may only want to purchase the supplemental game because he or she is a raffle game player. However, that player is incentivized to try the base game and the add-on game, which also provides the supplemental game for the same price as the supplemental game alone. As a result, lottery ticket sales may be increased.

In yet another embodiment, the supplemental game can only be played by a purchase of the hybrid game. In another embodiment, the supplemental game may be played for a premium wager without purchasing entry into the hybrid game. In one configuration, the premium wager is established such that the premium wager is the same wager for entry into both the hybrid game and the supplemental game. For example, the premium wager can be established to be two dollars, which may be the cost to play both the hybrid game and the supplemental game. Accordingly, the player that wants to play the supplemental game independently of the hybrid game is incentivized to provide the same wager for hybrid game, which also provides entry into the supplemental game. As an example, the hybrid game may be a lottery game, and the supplemental game may be a raffle game. A player may only want to purchase the supplemental game because he or she is a raffle game player. However, that player is incentivized to try the hybrid game, which also provides the supplemental game for the same price as the supplemental game alone. As a result, lottery ticket sales may be increased.

The processes described herein may be implemented in a general, multi-purpose or single purpose processor. Such a processor will execute instructions, either at the assembly, compiled or machine-level, to perform the processes. Those instructions can be written by one of ordinary skill in the art following the description of the figures corresponding to the processes and stored or transmitted on a computer readable medium. The instructions may also be created using source code or any other known computer-aided design tool. A computer readable medium may be any medium capable of carrying those instructions and include a CD-ROM, DVD, magnetic or other optical disc, tape, silicon memory (e.g., removable, non-removable, volatile or non-volatile), packetized or non-packetized data through wireline or wireless transmissions locally or remotely through a network.

A computer is herein intended to include any device that has a general, multi-purpose or single purpose processor as described above. For example, a computer may be a lottery terminal, interactive television, a kiosk, a vending machine, a set top box ("STB"), cell phone, portable media player, or the like.

In any of the configurations provided herein, the payout for the prizes may be guaranteed by a third party entity. As a result, a lottery provider may be able to provide a larger lottery prize than might otherwise be the case. Further, any of the configurations provided herein may be utilized as a part of a stand alone lottery game, an add-on lottery game, or both. In addition, any of the configurations provided herein may have tickets with a retail bar code to allow retailers to account for the sale of every ticket.

Any of the configurations described herein may utilize a fixed prize, a variable prize, or both. The variable prize may be a progressive prize that increases based on ticket sales revenue or a portion thereof. The progressive prize may be a prize offered as the top prize or a secondary prize in a stand alone hybrid game.

Any of the configurations described herein may be utilized with an add-on progressive game. In one embodiment, the selection of price point in the hybrid game effects the percentage of the progressive prize that may be won with the add-on progressive game. For example, a wager of two dollars in the hybrid game may result in twenty percent of the progressive prize that may be won in the progressive game whereas a wager of ten dollars in the hybrid game may result in eighty percent of the progressive prize that may be won in the progressive game. Alternatively, the selection of the price point in the hybrid game may have no impact on the determination of the progressive game prize. For example, a progressive game winner that provided a wager of two dollars in the hybrid game may win the same amount of the progressive prize as a player that provided a wager of ten dollars in the hybrid game. The add-on progressive game may be a similar or different game to that of the hybrid game.

The hybrid game ticket dispensing machine 800 may be utilized to provide a single ticket or separate tickets for both the hybrid game and the supplemental game. Alternatively, the hybrid game ticket dispensing machine 800 may be utilized as a primary game ticket dispensing machine. The primary game ticket dispensing machine may be utilized to provide the primary game ticket alone or a single ticket or separate tickets for the primary game and the supplemental game. Alternatively, the hybrid game ticket dispensing machine may be utilized as a supplemental game ticket dispensing machine to provide a single ticket or separate tickets for the supplemental game.

The hybrid game electronic apparatus 900 may be utilized to provide both the hybrid game and the supplemental game. Alternatively, the hybrid game electronic apparatus 900 may be utilized as a primary game electronic apparatus. The primary game electronic apparatus may be utilized to provide the primary game alone or the primary game and the supplemental game. Alternatively, the hybrid game electronic apparatus 900 may be utilized as a supplemental game electronic apparatus to provide the supplemental game. Accordingly, the ticket printer 904 is not utilized because the electronic version of the supplemental game may be paperless, i.e., virtual. For example, a virtual ticket may be displayed on the display console 902 for Internet-based play, web-based play, mobile devices, interactive television, or the like. Further, the display console 902 may be a monitor screen for a monitor game.

It is understood that the processes and systems described herein may also be applied in other types of processes and systems. Those skilled in the art will appreciate that the various adaptations and modifications of the embodiments of the processes and systems described herein may be configured without departing from the scope and spirit of the present processes and systems. Therefore, it is to be understood that, within the scope of the appended claims, the present processes and systems may be practiced other than as specifically described herein.

I claim:

1. A method comprising:

generating, with a wager slip generation apparatus, a plurality of wager slips corresponding to a hybrid game such that each wager slip indicates a plurality of parallel matrices that each has a set of corresponding parallel matrix specific numbers;

generating, with a prize category display module, a display that indicates a first spot low prize and a first spot high prize, the first spot low prize being won by a player providing a first wager and having a predetermined number of first spot matched parallel matrices, each first spot matched parallel matrix having a match between a first spot quantity of numbers selected by the player from the set of corresponding parallel matrix specific numbers and a quantity of randomly drawn numbers from the set of corresponding parallel matrix specific numbers, the first spot high prize being won by a player providing a second wager and having the predetermined number of first spot matched parallel matrices, the second wager being greater than the first wager, the first wager and the second wager each additionally providing entry for the player in a supplemental game;

generating, with the prize category display module, a display that indicates a second spot low prize and a second spot high prize, the second spot low prize being won by a player providing the first wager and having a predetermined number of second spot matched parallel matrices, each second spot matched parallel matrix having a match between a second spot quantity of numbers selected by the player from the set of corresponding parallel matrix specific numbers and a quantity of randomly drawn numbers from the set of corresponding parallel matrix specific numbers, the second spot high prize being won by a player providing a second wager and having the predetermined number of second spot matched parallel matrices, the second wager being greater than the first wager, the second spot high prize being less than the first spot high prize;

printing, with a ticket generation apparatus, a plurality of hybrid game tickets that are each based on player selections of numbers indicated on the plurality of wager slips and a set of player numbers for the supplemental game;

performing, with a hybrid game random selection apparatus, a random selection in each of the parallel matrices of at least one winning number from the set of corresponding parallel matrix specific numbers;

performing, with a supplemental game random selection apparatus, a random selection for a set of winning numbers for the supplemental game, the supplemental game random selection apparatus being distinct from the hybrid game random selection apparatus;

providing a hybrid game prize to a player in the hybrid game having a winning hybrid game ticket; and providing a supplemental game prize to a player in the supplemental game having a match between the set of player numbers for the supplemental game and the set of winning numbers for the supplemental game.

2. The method of claim 1, wherein the supplemental game is a drawing based game.

3. The method of claim 1, wherein the supplemental game is a raffle game.

4. The method of claim 1, wherein the match between the set of player numbers for the supplemental game and the set of winning numbers for the supplemental game is a full match and the supplemental game prize is a full match prize.

5. The method of claim 1, wherein the match between the set of player numbers for the supplemental game and the set of winning numbers for the supplemental game is a partial match and the supplemental game prize is a partial match prize.

6. The method of claim 1, wherein the match between the set of player numbers for the supplemental game and the set of winning numbers for the supplemental game is a full match or a partial match, the full match corresponding to the supplemental game prize being a full match prize, the partial match corresponding to the supplemental game prize being a partial match prize.

7. The method of claim 6, wherein the full match prize is a must go prize and the partial match prize is a must go prize.

8. The method of claim 6, wherein the full match prize is a non-must go prize and the partial match prize is a non-must go prize.

9. The method of claim 6, wherein the full match prize is a must go prize and the partial match prize is a non-must go prize.

10. The method of claim 6, wherein the full match prize is a non-must go prize and the partial match prize is a must go prize.

11. The method of claim 1, wherein distribution of the supplemental game prize is distinct for the first wager and the second wager.

12. The method of claim 1, wherein distribution of the supplemental game prize is uniform for the first wager and the second wager.

13. The method of claim 1, wherein the random selection in each of the parallel matrices of at least one winning number from the set of corresponding parallel matrix specific numbers is performed according to a first predetermined time interval and the random selection for the set of winning numbers for the supplemental game is performed according to a second predetermined time interval, the first predetermined time interval being distinct from the second predetermined time interval.

14. The method of claim 13, wherein the first predetermined time interval is a day and the second predetermined time interval is a week.

15. The method of claim 13, wherein the first predetermined time interval is instantaneous and the second predetermined time interval is an hour.

16. The method of claim 1, wherein payment of the hybrid game prize is guaranteed by a third party entity.

17. The method of claim 1, wherein payment of the supplemental game prize is guaranteed by a third party entity.

18. A computer program product comprising a tangible computer readable medium having a computer readable program, wherein the computer readable program when executed on a computer causes the computer to:

generate, with a wager slip generation apparatus, a plurality of wager slips corresponding to a hybrid game such that each wager slip indicates a plurality of parallel matrices that each has a set of corresponding parallel matrix specific numbers;

generate, with a prize category display module, a display that indicates a first spot low prize and a first spot high prize, the first spot low prize being won by a player providing a first wager and having a predetermined number of first spot matched parallel matrices, each first spot matched parallel matrix having a match between a first spot quantity of numbers selected by the player from the set of corresponding parallel matrix specific numbers and a quantity of randomly drawn numbers from the set of corresponding parallel matrix specific numbers, the first spot high prize being won by a player providing a second wager and having the predetermined number of first spot matched parallel matrices, the second wager being greater than the first wager, the first wager and the second wager each additionally providing entry for the player in a supplemental game;

generate, with the prize category display module, a display that indicates a second spot low prize and a second spot high prize, the second spot low prize being won by a player providing the first wager and having a predetermined number of second spot matched parallel matrices, each second spot matched parallel matrix having a match between a second spot quantity of numbers selected by the player from the set of corresponding parallel matrix specific numbers and a quantity of randomly drawn numbers from the set of corresponding parallel matrix specific numbers, the second spot high prize being won by a player providing a second wager and having the predetermined number of second spot matched parallel matrices, the second wager being greater than the first wager, the second spot high prize being less than the first spot high prize;

print, with a ticket generation apparatus, a plurality of hybrid game tickets that are each based on player selections of numbers indicated on the plurality of wager slips and a set of player numbers for the supplemental game;

perform, with a hybrid game random selection apparatus, a random selection in each of the parallel matrices of at least one winning number from the set of corresponding parallel matrix specific numbers;

perform, with a supplemental game random selection apparatus, a random selection for a set of winning numbers for the supplemental game, the supplemental game random selection apparatus being distinct from the hybrid game random selection apparatus;

provide a hybrid game prize to a player in the hybrid game having a winning hybrid game ticket; and provide a supplemental game prize to a player in the supplemental game having a match between the set of player numbers for the supplemental game and the set of winning numbers for the supplemental game.

19. The computer program product of claim 18, wherein the supplemental game is a drawing based game.

20. The computer program product of claim 18, wherein the supplemental game is a raffle game.

21. The computer program product of claim 18, wherein the match between the set of player numbers for the supplemental game and the set of winning numbers for the supplemental game is a full match and the supplemental game prize is a full match prize.

22. The computer program product of claim 18, wherein the match between the set of player numbers for the supplemental game and the set of winning numbers for the supplemental game is a partial match and the supplemental game prize is a partial match prize.

23. The computer program product of claim 18, wherein the match between the set of player numbers for the supplemental game and the set of winning numbers for the supplemental game is a full match or a partial match, the full match corresponding to the supplemental game prize being a full match prize, the partial match corresponding to the supplemental game prize being a partial match prize.

24. The computer program product of claim 23, wherein the full match prize is a must go prize and the partial match prize is a must go prize.

25. The computer program product of claim 23, wherein the full match prize is a non-must go prize and the partial match prize is a non-must go prize.

26. The computer program product of claim 23, wherein the full match prize is a must go prize and the partial match prize is a non-must go prize.

27. The computer program product of claim 23, wherein the full match prize is a non-must go prize and the partial match prize is a must go prize.

28. The computer program product of claim 18, wherein distribution of the supplemental game prize is distinct for the first wager and the second wager.

29. The computer program product of claim 18, wherein distribution of the supplemental game prize is uniform for the first wager and the second wager.

30. The computer program product of claim 18, wherein the random selection in each of the parallel matrices of at least one winning number from the set of corresponding parallel matrix specific numbers is performed according to a first predetermined time interval and the random selection for the set of winning numbers for the supplemental game is performed according to a second predetermined time interval, the first predetermined time interval being distinct from the second predetermined time interval.

31. The computer program product of claim 30, wherein the first predetermined time interval is a day and the second predetermined time interval is a week.

32. The computer program product of claim 30, wherein the first predetermined time interval is instantaneous and the second predetermined time interval is an hour.

33. The computer program product of claim 18, wherein payment of the hybrid game prize is guaranteed by a third party entity.

34. The computer program product of claim 18, wherein payment of the supplemental game prize is guaranteed by a third party entity.

35. A system comprising:

a wager slip generation apparatus that generates a plurality of wager slips corresponding to a hybrid game such that each wager slip indicates a plurality of parallel matrices that each has a set of corresponding parallel matrix specific numbers;

a prize category display module that generates a display that indicates a first spot low prize, a first spot high prize, a second spot low prize, and a second spot high prize, the first spot low prize being won by a player providing a first wager and having a predetermined number of first spot matched parallel matrices, each first spot matched parallel matrix having a match between a first spot quantity of numbers selected by the player from the set of corresponding parallel matrix specific numbers and a quantity of randomly drawn numbers from the set of corresponding parallel matrix specific numbers, the first spot high prize being won by a player providing a second wager and having the predetermined number of first spot matched parallel matrices, the second wager being greater than the first wager, the second spot low prize being won by a player providing the first wager and having a predetermined number of second spot matched parallel matrices, each second spot matched column having a match between a second spot quantity of numbers selected by the player from the set of corresponding parallel matrix specific numbers and a quantity of randomly drawn numbers from the set of corresponding parallel matrix specific numbers, the second spot high prize being won by a player providing a second wager and having the predetermined number of second spot matched parallel matrices, the second wager being greater than the first wager, the second spot high prize being less than the first spot high prize, the first wager and the second wager each additionally providing entry for the player in a supplemental game;

a hybrid game ticket printer that prints a plurality of hybrid game tickets that are each based on player selections of numbers indicated on the plurality of wager slips and a set of player numbers for the supplemental game on each of the plurality of hybrid game tickets;

a hybrid game random selection apparatus that performs a random selection in each of the parallel matrices of at least one winning number from the set of corresponding parallel matrix specific numbers;

a supplemental game random selection apparatus that performs a random selection for a set of winning numbers for the supplemental game;

a hybrid game prize distribution module that provides a hybrid game prize to a player having a winning hybrid game ticket; and a supplemental game prize distribution module that provides a supplemental game prize to a player in the supplemental game having a match between the set of player numbers for the supplemental game and the set of winning numbers for the supplemental game.

36. The system of claim 35, wherein the supplemental game is a drawing based game.

37. The system of claim 35, wherein the supplemental game is a raffle game.

38. The system of claim 35, wherein the match between the set of player numbers for the supplemental game and the set of winning numbers for the supplemental game is a full match and the supplemental game prize is a full match prize.

39. The system of claim 35, wherein the match between the set of player numbers for the supplemental game and the set of winning numbers for the supplemental game is a partial match and the supplemental game prize is a partial match prize.

40. The system of claim 35, wherein the match between the set of player numbers for the supplemental game and the set of winning numbers for the supplemental game is a full match or a partial match, the full match corresponding to the supplemental game prize being a full match prize, the partial match corresponding to the supplemental game prize being a partial match prize.

41. The system of claim 40, wherein the full match prize is a must go prize and the partial match prize is a must go prize.

42. The system of claim 40, wherein the full match prize is a non-must go prize and the partial match prize is a non-must go prize.

43. The system of claim 40, wherein the full match prize is a must go prize and the partial match prize is a non-must go prize.

44. The system of claim 40, wherein the full match prize is a non-must go prize and the partial match prize is a must go prize.

45. The system of claim 35, wherein distribution of the supplemental game prize is distinct for the first wager and the second wager.

46. The system of claim 35, wherein distribution of the supplemental game prize is uniform for the first wager and the second wager.

47. The system of claim 35, wherein the random selection in each of the parallel matrices of at least one winning number from the set of corresponding parallel matrix specific numbers is performed according to a first predetermined time interval and the random selection for the set of winning numbers for the supplemental game is performed according to a second predetermined time interval, the first predetermined time interval being distinct from the second predetermined time interval.

48. The system of claim 47, wherein the first predetermined time interval is a day and the second predetermined time interval is a week.

49. The system of claim 47, wherein the first predetermined time interval is instantaneous and the second predetermined time interval is an hour.

50. The system of claim 35, wherein payment of the hybrid game prize is guaranteed by a third party entity.

51. The system of claim 35, wherein payment of the supplemental game prize is guaranteed by a third party entity.

52. A method comprising:

generating, with a prize category display module, a display that indicates (i) a first prize and a second prize for a primary game and (ii) a supplemental game prize, the first prize being won by a player that provides a first wager and has a match between a set of primary game player numbers and a set of primary game winning numbers, the second prize being won by a player that provides a second wager and has a match between the set of primary game player numbers and the set of primary game winning numbers, the second wager being greater than the first wager, the second prize being greater than the first prize, each of the first wager and the second wager additionally providing entry into a supplemental game corresponding to the supplemental game prize, the supplemental game being distinct from the primary game;

printing, with a ticket generation apparatus, a plurality of game tickets that are each based on the set of primary game player numbers and a set of supplemental game player numbers;

performing, with a primary game random selection apparatus, a random selection of the set of primary game winning numbers;

performing, with a supplemental game random selection apparatus, a random selection of a set of supplemental game winning numbers, the supplemental game random selection apparatus being distinct from the primary game random selection apparatus, the supplemental game random selection apparatus being distinct from the primary game random selection apparatus;

providing a primary game prize to a player in the primary game having a winning primary game ticket based on the match between the set of primary game player numbers and the set of primary game winning numbers; and providing the supplemental game prize to a player in the supplemental game having a winning supplemental game ticket based on a match between the set of supplemental game player numbers and the set of supplemental game winning numbers.

53. The method of claim 52, wherein the supplemental game is a drawing based game.

54. The method of claim 52, wherein the supplemental game is a raffle game.

55. The method of claim 52, wherein the match between the set of supplemental game player numbers and the set of supplemental game winning numbers is a full match and the supplemental game prize is a full match prize.

56. The method of claim 52, wherein the match between the set of supplemental game player numbers and the set of supplemental game winning numbers is a partial match and the supplemental game prize is a partial match prize.

57. The method of claim 52, wherein the match between the set of player numbers for the supplemental game and the set of winning numbers for the supplemental game is a full match or a partial match, the full match corresponding to the supplemental game prize being a full match prize, the partial match corresponding to the supplemental game prize being a partial match prize.

58. The method of claim 57, wherein the full match prize is a must go prize and the partial match prize is a must go prize.

59. The method of claim 57, wherein the full match prize is a non-must go prize and the partial match prize is a non-must go prize.

60. The method of claim 57, wherein the full match prize is a must go prize and the partial match prize is a non-must go prize.

61. The method of claim 57, wherein the full match prize is a non-must go prize and the partial match prize is a must go prize.

62. The method of claim 52, wherein distribution of the supplemental game prize is distinct for the first wager and the second wager.

63. The method of claim 52, wherein distribution of the supplemental game prize is uniform for the first wager and the second wager.

64. The method of claim 52, wherein the random selection for the set of primary game numbers is performed according to a first predetermined time interval and the random selection for the set of winning numbers for the supplemental game is performed according to a second predetermined time interval, the first predetermined time interval being distinct from the second predetermined time interval.

65. The method of claim 64, wherein the first predetermined time interval is a day and the second predetermined time interval is a week.

66. The method of claim 64, wherein the first predetermined time interval is instantaneous and the second predetermined time interval is an hour.

67. The method of claim 52, wherein payment of a hybrid game prize is guaranteed by a third party entity.

68. The method of claim 52, wherein payment of the supplemental game prize is guaranteed by a third party entity.

69. A computer program product comprising a tangible computer readable medium having a computer readable program, wherein the computer readable program when executed on a computer causes the computer to:

generate, with a prize category display module, a display that indicates (i) a first prize and a second prize for a primary game and (ii) a supplemental game prize, the first prize being won by a player that provides a first wager and has a match between a set of primary game player numbers and a set of primary game winning numbers, the second prize being won by a player that provides a second wager and has a match between the set of primary game player numbers and the set of primary game winning numbers, the second wager being greater than the first wager, the second prize being greater than the first prize, each of the first wager and the second wager additionally providing entry into a supplemental game, the supplemental game being distinct from the primary game;

print, with a ticket generation apparatus, a plurality of game tickets that are each based on the set of primary game player numbers and a set of supplemental game player numbers; perform, with a primary game random selection apparatus, a random selection of the set of primary game winning numbers;

perform, with a supplemental game random selection apparatus, a random selection of a set of supplemental game winning numbers, the supplemental game random selection apparatus being distinct from the primary game random selection apparatus, the supplemental game random selection apparatus being distinct from the primary game random selection apparatus;

provide a primary game prize to a player in the primary game having a winning primary game ticket based on the match between the set of primary game player numbers and the set of primary game winning numbers; and provide the supplemental game prize to a player in the supplemental game having a winning supplemental game ticket based on a match between the set of supplemental game player numbers and the set of supplemental game winning numbers.

70. The computer program product of claim 69, wherein the supplemental game is a drawing based game.

71. The computer program product of claim 69, wherein the supplemental game is a raffle game.

72. The computer program product of claim 69, wherein the match between the set of supplemental game player numbers and the set of supplemental game winning numbers is a full match and the supplemental game prize is a full match prize.

73. The computer program product of claim 69, wherein the match between the set of supplemental game player numbers and the set of supplemental game winning numbers is a partial match and the supplemental game prize is a partial match prize.

74. The computer program product of claim 69, wherein the match between the set of player numbers for the supplemental game and the set of winning numbers for the supplemental game is a full match or a partial match, the full match corresponding to the supplemental game prize being a full match prize, the partial match corresponding to the supplemental game prize being a partial match prize.

75. The computer program product of claim 74, wherein the full match prize is a must go prize and the partial match prize is a must go prize.

76. The computer program product of claim 74, wherein the full match prize is a non-must go prize and the partial match prize is a non-must go prize.

77. The computer program product of claim 74, wherein the full match prize is a must go prize and the partial match prize is a non-must go prize.

78. The computer program product of claim 74, wherein the full match prize is a non-must go prize and the partial match prize is a must go prize.

79. The computer program product of claim 69, wherein distribution of the supplemental game prize is distinct for the first wager and the second wager.

80. The computer program product of claim 69, wherein distribution of the supplemental game prize is uniform for the first wager and the second wager.

81. The computer program product of claim 69, wherein the random selection for the set of primary game numbers is performed according to a first predetermined time interval and the random selection for the set of winning numbers for the supplemental game is performed according to a second predetermined time interval, the first predetermined time interval being distinct from the second predetermined time interval.

82. The computer program product of claim 81, wherein the first predetermined time interval is a day and the second predetermined time interval is a week.

83. The computer program product of claim 81, wherein the first predetermined time interval is instantaneous and the second predetermined time interval is an hour.

84. The computer program product of claim 69, wherein payment of a hybrid game prize is guaranteed by a third party entity.

85. The computer program product of claim 69, wherein payment of the supplemental game prize is guaranteed by a third party entity.

86. A system comprising:

a prize category display module that generates a display that indicates (i) a first prize and a second prize for a primary game and (ii) a supplemental game prize, the first prize being won by a player that provides a first wager and has a match between a set of primary game player numbers and a set of primary game winning numbers, the second prize being won by a player that provides a second wager and has a match between the set of primary game player numbers and the set of primary game winning numbers, the second wager being greater than the first wager, the second prize being greater than the first prize, each of the first wager and the second wager additionally providing entry into a supplemental game, the supplemental game being distinct from the primary game;

a ticket printer that prints a plurality of game tickets that are each based on the set of primary game player numbers and a set of supplemental game player numbers;

a primary game random selection apparatus that performs a random selection of the set of primary game winning numbers;

a supplemental game random selection apparatus that performs a random selection of a set of supplemental game winning numbers, the supplemental game random selection apparatus being distinct from the primary game random selection apparatus, the supplemental game random selection apparatus being distinct from the primary game random selection apparatus;

a primary game prize distribution module that provides a primary game prize to a player in the primary game having a winning primary game ticket based on the match between the set of primary game player numbers and the set of primary game winning numbers; and a supplemental game prize distribution module that provides the supplemental game prize to a player in the supplemental game having a winning supplemental game ticket based on a match between the set of supplemental game player numbers and the set of supplemental game winning numbers.

87. The system of claim 86, wherein the supplemental game is a drawing based game.

88. The system of claim 86, wherein the supplemental game is a raffle game.

89. The system of claim 86, wherein the match between the set of supplemental game player numbers and the set of supplemental game winning numbers is a full match and the supplemental game prize is a full match prize.

90. The system of claim 86, wherein the match between the set of supplemental game player numbers and the set of supplemental game winning numbers is a partial match and the supplemental game prize is a partial match prize.

91. The system of claim 86, wherein the match between the set of player numbers for the supplemental game and the set of winning numbers for the supplemental game is a full match or a partial match, the full match corresponding to the supplemental game prize being a full match prize, the partial match corresponding to the supplemental game prize being a partial match prize.

92. The system of claim 91, wherein the full match prize is a must go prize and the partial match prize is a must go prize.

93. The system of claim 91, wherein the full match prize is a non-must go prize and the partial match prize is a non-must go prize.

94. The system of claim 91, wherein the full match prize is a must go prize and the partial match prize is a non-must go prize.

95. The system of claim 91, wherein the full match prize is a non-must go prize and the partial match prize is a must go prize.

96. The system of claim 91, wherein distribution of the supplemental game prize is distinct for the first wager and the second wager.

97. The system of claim 91, wherein distribution of the supplemental game prize is uniform for the first wager and the second wager.

98. The system of claim 91, wherein the random selection for the set of primary game numbers is performed according to a first predetermined time interval and the random selection for the set of winning numbers for the supplemental game is performed according to a second predetermined time interval, the first predetermined time interval being distinct from the second predetermined time interval.

99. The system of claim 98, wherein the first predetermined time interval is a day and the second predetermined time interval is a week.

100. The system of claim 98, wherein the first predetermined time interval is instantaneous and the second predetermined time interval is an hour.

101. The system of claim 86, wherein payment of a hybrid game prize is guaranteed by a third party entity.

102. The system of claim 86, wherein payment of the supplemental game prize is guaranteed by a third party entity.

* * * * *